US007523724B2

(12) United States Patent
Duraiswamy et al.

(10) Patent No.: US 7,523,724 B2
(45) Date of Patent: Apr. 28, 2009

(54) IN TRANSIT DESULFURIZATION OF WIDELY AVAILABLE FUELS

(75) Inventors: Kandaswamy Duraiswamy, Huntington Beach, CA (US); Anand Chellappa, Albuquerque, NM (US)

(73) Assignee: Intelligent Energy, Inc., Long Beach, CA (US)

( * ) Notice: Subject to any disclaimer, the term of this patent is extended or adjusted under 35 U.S.C. 154(b) by 189 days.

(21) Appl. No.: 11/733,718

(22) Filed: Apr. 10, 2007

(65) Prior Publication Data

US 2008/0073249 A1 Mar. 27, 2008

Related U.S. Application Data

(63) Continuation-in-part of application No. 11/534,764, filed on Sep. 25, 2006.

(60) Provisional application No. 60/895,106, filed on Mar. 15, 2007.

(51) Int. Cl.
*F02B 43/00* (2006.01)
*F02B 63/00* (2006.01)

(52) U.S. Cl. ..... 123/1 A; 123/2; 208/58

(58) Field of Classification Search ..... 123/1 R, 123/1 A, 2, 3, 198 R; 208/58
See application file for complete search history.

(56) References Cited

U.S. PATENT DOCUMENTS 6,129,835 A * 10/2000 Lesieur et al. ..... 123/1 A

* cited by examiner

*Primary Examiner*—Noah Kamen
(74) *Attorney, Agent, or Firm*—Mark H. Krietzman; Luce, Forward, Hamilton & Scripps, LLP

(57) ABSTRACT

A method of and system for reducing engine environmental atmospheric pollution emissions from a vehicle having a combustion engine utilizing hydrocarbon fuel for at least one of propulsion and auxiliary electrical power is disclosed. The method basically includes providing an unprocessed bulk fuel storage container and a clean processed fuel tank on the vehicle, supplying the engine for propulsion with fuel from the unprocessed fuel storage container when the vehicle is beyond a predetermined distance from an area having environmental restrictions passing a portion of unprocessed fuel through a desulphurization process to fill a clean fuel storage container while the vehicle is in motion and supplying the combustion engine for one of propulsion and auxiliary electrical power from clean fuel in the processed fuel storage container when the vehicle is within an area having environmental restrictions.

6 Claims, 9 Drawing Sheets

100

132
124
Retentate
104
112
114
NF
106
108
110
Bulk Fuel
116
126
102
120
128
Clean Fuel Tank
118
130

IN TRANSIT DESULFURIZATION OF WIDELY AVAILABLE FUELS

RELATED APPLICATIONS

This application is a Continuation-in-Part of U.S. patent application Ser. No. 11/534,764, entitled Multi Stage Sulfur Removal System and Process for an Auxiliary Fuel System, filed Sep. 25, 2006. This application also claims the benefit of and priority to U.S. Provisional Application Ser. No. 60/895,106, filed Mar. 15, 2007, the contents of which are incorporated by reference herein in its entirety.

BACKGROUND

1. Field

This disclosure relates to fuel systems and methods for engines and more particularly to a system and method for producing low-sulfur fuel from bulk fuel onboard a vehicle while the vehicle is in transit.

2. General Background

Sulfur content in hydrocarbon fuels used in various modes of transportation ends up in the atmosphere in the form of pollutants including oxides of nitrogen ($NO_X$), oxides of sulfur ($SO_X$), acid rain and particulate matter (PM), resulting in significant adverse effects on public health. Certain national and regional governments, especially in the developed world, have undertaken programs to require reduced sulfur content in transportation fuel supplies to mitigate this problem. Such measures can make a substantial impact on emissions from ground transportation vehicles where fuel providers in this market clearly fall under the jurisdiction of such national and regional governments.

In contrast, operators of ocean-going vessels and international commercial aircraft by necessity obtain fuel throughout the world, often in areas where fuel specifications, especially sulfur content, are not so tightly regulated. Ocean-going vessels and aircraft will carry into and continue to use this "dirty" fuel in areas more sensitive to pollutant air emissions. For example, cargo and tanker ships calling at the Port of Los Angeles will continue to burn the "dirty" fuel with which they were filled elsewhere while they are near or in the Port, contributing to the region's air quality problems.

Incentives to "clean up" fuel supplies on a global scale will not be in place in the foreseeable future. Combustion engine exhaust gas after-treatment systems are actually poisoned by sulfur such that their use for sulfur cleanup is not possible. Achieving low sulfur emissions therefore has depended on the availability of low sulfur fuel. This represents the prior art for achieving low sulfur emissions from ocean-going vessels and commercial aircraft. What is needed, then, is a mechanism to reduce the sulfur content of fuels before entry into combustion engines onboard the vehicles using these "dirty" fuels.

SUMMARY

The present disclosure provides a system and method for reducing sulfur content of readily available fuels onboard a vehicle, while the vehicle is being operated in regions of the world having lesser environmental restrictions so that when these same vehicles are within restrictive areas, cleansed fuel may be utilized. The system may also be implemented on existing marine vessels, land vehicles and aircraft to provide in transit fuel processing.

The financial barrier to providing low-sulfur fuel on a global scale is a long term challenge given the enormous investments required. In the meantime excessive sulfur emissions are causing problems today. The presently disclosed system and method allows significant reduction of sulfur emissions in sensitive geographic areas in the near term with readily available low-cost fuels.

Adoption of the disclosed method will provide benefits to multiple stakeholder groups. Industries and companies operating ocean-going vessels and aircraft will have a low-cost option for reducing sulfur emissions when operating in regulated areas. Air quality management regulatory agencies will have a tool for reducing sulfur emissions that does not require large investments in new infrastructure. Public health in affected areas would be improved in the intervening period between adoption of this method and wider availability of cost-effective low-sulfur fuel.

Exemplary embodiments of a system and process for producing a processed fuel stream containing low concentration of sulfur compounds from a primary fuel stream from an unprocessed fuel storage tank on a vessel such as a tanker or cargo vessel according to an exemplary implementation are disclosed. The processing system generally takes a portion of bulk fuel from the bulk storage tank in parallel with operation of the vessel while at sea, for example, and strips contaminants and sulfur compounds from the bulk fuel and stores this cleansed fuel in a separate storage tank for use when the vessel is within environmentally limited space such as a port with restrictions on air quality. This system may also be utilized in propeller driven or jet aircraft, trucks, and any other vehicle that utilizes hydrocarbon fuels.

In situations where the processing throughput meets or exceeds the immediate fuel needs during vehicle operation, the cleansed fuel may be used directly, with the excess being returned to storage for future use. When the processing throughput rate is less than the combustion engine's immediate needs, the fuel needs may be met from unclean or bulk fuel stores or previously cleansed fuel stores.

Basically the onboard system of the present disclosure for a vehicle requires that the vehicle have at least two fuel storage tanks or containers: a bulk fuel container and a cleansed fuel container. During operation of the vehicle, fuel for a combustion engine is drawn from one of these fuel containers. In parallel, fuel from the bulk storage container is processed through an onboard sulfur removal system and either recycled to the cleansed fuel container or fed directly to the combustion engine.

One exemplary embodiment includes a first separation stage that isolates a stage-one permeate or filtrate stream and a stage-one retentate stream from a portion of the primary fuel stream from the bulk tank. The stage-one retentate stream is returned to the bulk tank. The stage-one permeate/filtrate stream is either directly utilized or fed to a second separation stage to further reduce the sulfur content. In many cases, the stage-one permeate/filtrate is clean enough to meet the clean fuel requirements.

In the cases where the stage-one permeate/filtrate is not clean enough to meet the requirements, a second separation stage may be employed. The second separation stage isolates a stage-two permeate or filtrate stream and a stage-two retentate stream from the stage-one permeate stream. This stage-two retentate stream becomes the cleansed fuel stream containing even lower concentrations of sulfur compounds. This cleansed fuel stream is then fed directly to the combustion engine as needed, with the excess being returned to the clean fuel storage tank. In such an embodiment the stage-one retentate stream and the stage-two permeate stream are preferably mixed and returned to the unprocessed bulk fuel storage tank. The cleansed fuel stream may be utilized to fuel the vehicle engine at any time or may be stored onboard for use particularly when the vehicle is in environmentally sensitive locations.

A combination of the above embodiments may also be provided. This combination system utilizes three storage tanks: a bulk fuel tank, a first separation clean tank and a second separation clean tank. In this alternative embodiment the two clean tanks may be used to supply fuel to either different combustion engines or to combustion engines when in different environmentally sensitive locations. In this combination embodiment, a portion of the stage-one permeate stream is sent to the first separation clean tank and the remainder is further processed in the second separation stage. The first separation stage retentate is returned to the bulk tank and the second separation stage permeate/filtrate can either be returned to the bulk tank or to the first separation stage clean tank.

According to a further exemplary implementation, each of the systems described above for separating a clean fuel stream containing low sulfur compounds from a bulk fuel stream may also be done via different mechanisms. For example, 1) by pervaporation (PV) which creates permeate under vacuum; and 2) by nanofiltration (NF) creating a filtrate. In both implementations, the clean fuel stream is produced while the main propulsion systems are in operation utilizing unprocessed fuel. The clean fuel stream thus generated may be directly utilized or stored specifically for use when the vessel is in or in the vicinity of the port, or, in the case of a land vehicle or aircraft, in an environmentally restricted area. The bulk fuel may be pretreated in liquid phase by oxidation with air, hydrogen peroxide, organic peroxides or ozone or by alkylation of sulfur containing molecules with suitable catalysts to increase the molecular size and to change the polarity or solubility of the modified sulfur compounds to enable the separation of sulfur compounds from the fuel.

The PV process includes: isolating a stage-one permeate stream and a stage-one retentate stream from the bulk primary fuel stream; evaporating the stage-one permeate stream at a vacuum; isolating a stage-two permeate stream and a stage-two retentate stream from the stage-one permeate stream, the stage-two retentate stream comprising a fuel stream containing low concentrations of sulfur compounds; and evaporating the stage-two permeate stream at a vacuum for return of the stage-two permeate stream to the primary fuel stream. The stage-two retentate stream is then utilized as the clean fuel stream containing low sulfur compounds.

According to an additional exemplary implementation, a system for separating a fuel stream containing low concentrations of sulfur compounds from a primary bulk fuel stream includes: a bulk fuel supply; a stage-one separator; a stage-two separator; a first supply line connecting the bulk fuel supply to the stage-one separator; a second supply line connecting the stage-one separator and the stage-two separator. The first supply line conveys a fuel stream from the fuel supply to the stage-one separator. The stage-one separator produces a stage-one permeate stream and a stage-one retentate stream from the stage-one fuel supply stream. The second supply line conveys the stage-one permeate stream from the stage-one separator, to the stage-two separator. The stage-two separator produces a stage-two permeate stream and a stage-two retentate stream. The stage-two retentate stream produced is a fuel stream containing low concentrations of sulfur compounds. In this system, the stage-one retentate stream and stage-two permeate are then mixed and returned to the primary fuel stream.

A marine vessel fuel supply system in accordance with the present disclosure that conventionally has a bulk fuel storage tank and a clean fuel storage tank may be easily and cost-effectively modified to include a fuel processing system that includes: a stage-one separator providing a gaseous stage-one permeate stream and a stage-one retentate stream from a primary fuel stream from the bulk tank; a first eductor associated with the stage-one separator, the eductor providing a vacuum and cooling energy to condense the stage-one permeate vapor using the cooled stage-one permeate liquid as the motive fluid for the first eductor; and a stage-two separator providing a stage-two retentate stream and a gaseous stage-two permeate stream from the condensed stage-one permeate stream, the stage-two retentate stream comprising a clean fuel stream containing low concentration of sulfur compounds; and a second eductor associated with the stage-two separator, the eductor using the cooled stage-one retentate as the motive fluid to provide a vacuum for stage-two permeate vapor and condense and mix the stage-two permeate vapor with the stage-one retentate. The stage-two permeate and stage-one retentate is returned to the bulk tank. The vacuum produced may not only be generated by the use of eductors with process liquid as motive fluid as above described. Compressed gases such as air or $N_2$ enriched air may be used as the motive fluid. Alternatively, a motor-driven vacuum pump may be utilized to generate the vacuum.

Another embodiment may include: a fuel supply; a stage-one separator; a reactive de-sulfurization catalyst; a sorbent bed downstream of the catalyst; a first supply line connecting the fuel supply to the stage-one separator; a first vapor phase supply line connecting the stage-one separator to the reactive de-sulfurization catalyst; a first sorbent bed feed line; a first condensed supply line; and a first reactant supply line. The first supply line conveys a fuel stream from the bulk fuel supply to the stage-one separator. The stage-one separator produces a stage-one permeate stream and a stage-one retentate stream from the stage-one fuel supply stream. Then the first vapor phase supply line conveys the stage-one permeate stream from the stage-one separator, to the reactive de-sulfurization catalyst. The reactant supply line supplies reactant to the reactive de-sulfurization catalyst. The catalyst supports the chemical reaction of the sulfur species in the stage-one permeate with the reactant to modify the sulfur species. The first sorbent bed feed lines connects the reactant catalyst with the sorbent bed. The modified sulfur species adsorb or absorb to the sorbent and the remaining stage-one permeate is condensed for later use or processing.

Each one of the processing systems described above may be used to supply fuel to a clean fuel tank for a combustion engine for use as auxiliary power or may be utilized for main propulsion power of the vessel as dictated by the location of the vessel, i.e. within a restricted emissions area such as a port of call that has emissions limits or unrestricted areas such as international waters beyond the 50 mile limit, for example, of any port of call. Such cleansed fuels may also be further refined for specialized uses, such as for use in fuel cells, etc.

As these examples indicate, depending on the crudeness of the bulk fuel that is being conventionally utilized several different levels of desulfurization stages may be required to provide sufficient clean fuel to meet a particular set of environmental standards. These stages may be utilized singly or sequentially utilized as the particular requirements and fuel sources dictate. Where weight and space is at a premium, such as in aircraft, one separation stage may be all that is needed onboard. Where weight and space is not a significant concern, such as in ocean-going vessels, full multi-stage separation systems may be utilized to advantage.

DRAWINGS

The above-mentioned features and objects of the present disclosure will become more apparent with reference to the following description taken in conjunction with the accompanying drawings.

DETAILED DESCRIPTION

The systems and methods in accordance with the present disclosure allows reductions in sulfur emissions from ocean-going vessels and aircraft in international air space using readily available fuels. It involves the following key steps:

First, utilization of readily available existing fuels, i.e. "parent" or bulk fuel, which may contain high levels of sulfur, for ocean-going vessels and aircraft, while the vessel is away from areas of emission restriction, including but not limited to marine gas oil, marine diesel oil, fuel oil, jet fuel and MIL-SPEC fuels;

Second, preferably continuous production of a "clean" processed fuel stream from the bulk fuel using processing methods that include desulfurization of the fuels, which can be effected using processes such as hydro desulfurization; and Third, the "clean" fuel stream that contains a lower amount of the pollution-causing entities such as sulfur compounds compared to the parent bulk fuel is then stored particularly for later use by the vessel when in port.

Production of such a "clean" fuel, by separation of relatively low-sulfur fuel from the original high sulfur content bulk, or "parent", fuel supply onboard the vessel or craft while the vessel or craft is in transit to its destination is particularly advantageous when compared to purchasing separate clean fuel supplies when in port. Such clean fuels can cost two to three times that of bulk fuel.

The "clean" fuel stream contains a lower amount of the pollution causing entities such as sulfur compounds compared to the parent fuel. The separated low-sulfur fuel is preferably kept separately in a dedicated storage vessel/tank. High-sulfur fuel components are directed back to the bulk fuel supply. No fuel is wasted in the present contemplated system.

The system and process of this disclosure augments the fuel circulation and filtration process currently used in marine vessels.

Figure 1:
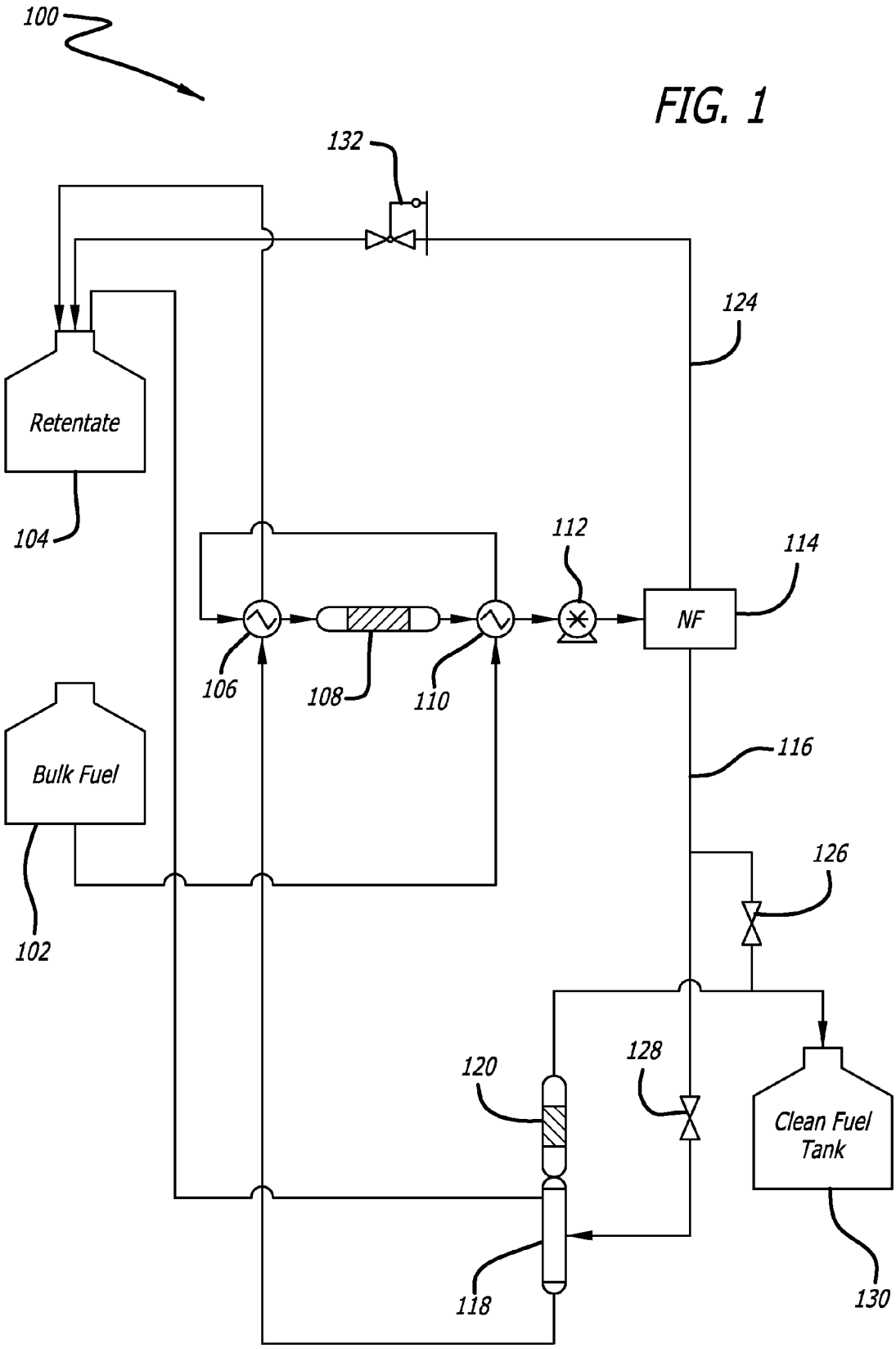
FIG. 1 is a simplified schematic diagram of a liquid desulfurization system and process in accordance with the present disclosure.

FIG. 1 illustrates a simplified schematic representation of one exemplary system and process 100 according to an embodiment of this disclosure; illustrating a complete liquid phase reaction stage and a filtration stage in which a dirty fuel is cleansed into a clean fuel without vaporization of portions of the fuel. The system 100 comprises a logistic or primary fuel stored in a bulk fuel tank 102. The primary fuel could be any commercially available transportation or logistic fuel. In exemplary implementations, the fuels could include gasoline, kerosene, jet fuel, diesel, military specification fuels and any other logistic fuels available from various sources throughout the world.

These primary fuels are in particular typically comprised of a mixture of components that can consist of a mixture of hydrocarbons that can be split into several different groups. One of these groups include heavy sulfur compounds, which are multi-ringed and multi-branched hydrocarbons. For example, the heavy sulfur compounds include the di-benzothiopenes having at least three ring structures and are aromatic compounds. Another group is the light sulfur compounds including, for example, mercaptans, thiopenes, and benzo-thiopenes. The majority of sulfur compounds are removed in the system and processes in this disclosure.

Alpha-olefins are organic compounds having between 6 and 12 carbon atoms. In the exemplary implementation illustrated in FIG. 1, a plug flow reactor 108 is utilized to react the alpha-olefins with the primary fuel stream. Plug flow reactors have a high volumetric unit conversion, run for long periods of time without labor, and can have excellent heat transfer due to the ability to customize the diameter of the reactor. Other reactors that could also be utilized including down-flow, liquid phase, fixed bed process; an up-flow, fixed bed, trickle phase process; an ebulating, fluidized bed process; or a transport, fluidized bed process.

The raw unprocessed dirty fuel in the bulk tank 102 is first preferably fed through a first regenerative heat exchanger 110 and then through a second regenerative heat exchanger 106 to increase the temperature of the raw bulk fuel to a range of 25-150° C. From the heat exchanger 106, the heated fuel stream is passed through a dehydrogenation/alkylation plug flow bed 108 where alpha-olephins are bound to the sulfur compounds in the fuel passing through the bed 108. The alpha-olefins react with the thiophenic compounds in the primary fuel to alkylate the thiophenic compounds with acidic alkylation catalyst particles under alkylation conditions in an alkylation zone to provide a reacted output fuel stream comprising hydrocarbons containing alkylated thiophenic sulfur compounds. The so modified fuel then passes through the regenerative side of a heat exchanger 110 to pump 112. The pump 112 pressurizes the fuel to about 50 bar and passes the pressurized fuel to nanofiltration membrane module 114.

The nanofiltration module 114 separates the large alkylated thiophenic sulfur compounds from the fuel stream resulting in a low pressure cleansed fuel 116 and a retentate fuel stream 124 that may alternatively be fed via pressure reducing valve 132 to retentate tank 104 as shown, or, if desired, can simply be returned to the bulk fuel tank 102. The fuel in the retentate tank 104 may be further processed in systems described with reference herein to FIGS. 2-12 or may be fed directly to the main propulsion engine or other power source as may be appropriate depending on its content.

Figure 9:
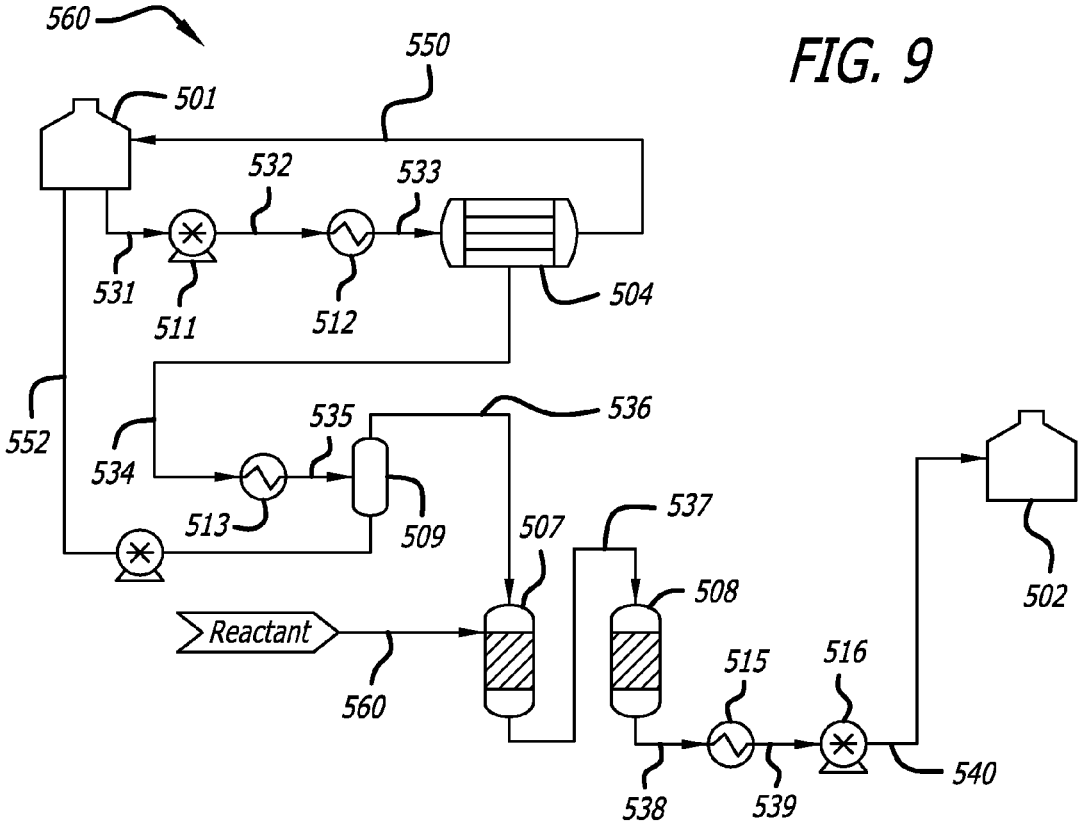
FIG. 9 is a schematic flow diagram of another exemplary system illustrative of an alternative system shown in FIG. 7.
Figure 10:
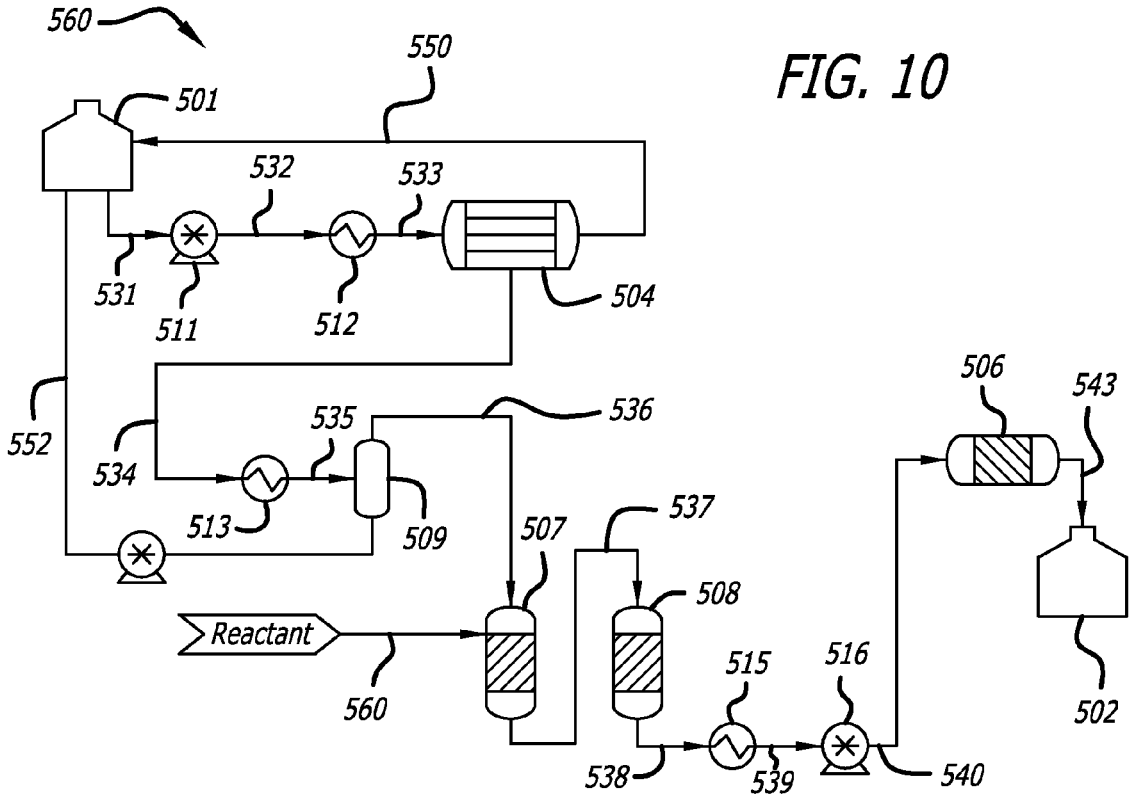
FIG. 10 is a schematic flow diagram of another exemplary system illustrative of an alternative system as in FIG. 7.

The cleansed fuel 116 may be used directly via valve 126 as clean fuel 122 and stored in the clean fuel tank 130 for use while in restricted environmental emissions areas if the sulfur content is permissibly low, or, it may be further processed via valve 128 through further filtration and separation processes, such as through a fractionator 118 and trap 120 (similar to element 508 in FIG. 9) in order to achieve the desired reduced level of sulfur compounds required by the particular port regulations or required by a particular engine application as a clean fuel 122. The fuel stream 116 or 122 may also be directed through a catalyst bed (as shown in FIG. 10) for further filtration and cleansing. The fractionator 118 and trap 120 may be replaced by an HFM module, if desired.

In exemplary implementations, the plug flow reactor 108 utilizes a solid acid catalyst to speed up the alkylation reaction. Many different types of acid catalysts may be utilized for the alkylation reaction. Some implementations utilizing catalysts having either Bronsted acid sites or Lewis acid sites are useful for the process of this disclosure. Some typical Lewis acid catalysts may include those derived from $AlCl_3$, $FeCl_3$, $SbCl_3$, $BF_3$, $ZnCl_2$, $TiC_{14}$ and $P_2O_5$; but particularly, acid catalysts such as $AlCl_3$/silica, $AlCl_2$/silica, $BF_3$/silica, Co/Mo/alumina, Mo/alumina, $MOS_2$ are useful for the disclosed process. Typical Bronsted acids include HF, $H_2$ $SO_4$, metallosilicates, silica-alumina, sulfonic acid resins, and similar catalysts. In exemplary implementations, the catalysts preferred are crystalline aluminosilicate zeolites. In the second stage of the process, the reacted fuel stream is passed through a nanofiltration membrane 114. In this stage of the process, the higher molecular weight alkylated sulfur compounds are stripped from the light sulfur free clean fuel stream using the nanofiltration membrane. In exemplary implementations, the nanofiltration membrane has pores in a size range of 5 to 50 angstroms.

In exemplary implementations of the process, the alkylated sulfur compounds have a higher molecular weight than the hydrocarbons found in the rest of the fuel. The alkylated sulfur compounds have a molecular weight over 200 daltons. The nanofiltration membrane module 114 removes the majority of the sulfur compounds having a molecular weight over 200 daltons. As a result, the nanofiltration device 114 splits the reacted fuel stream into two parts, a light sulfur free clean fuel stream 116 and a heavy sulfur-rich retentate stream that goes back to tank 104, or, optionally may be returned to the bulk tank 102.

As a result, around 90% of the logistic fuel stream from tank 102 is converted into desulfurized clean fuel 116 in the liquid phase. There is no need for cyclic regeneration of sorbent beads or vaporizing and condensing steps as required by some alternative methods. This exemplary embodiment 100 of the process is designed to provide a low-sulfur, clean fuel stream 116 usable in an auxiliary power unit onboard a vehicle by extracting a fraction of the fuel being sent to the primary application, such as to drive the engine or primary generator.

Alternatively, the sulfur rich retentate feed 124 comprising the heavy alkylated sulfur compounds isolated from the nanofiltration membrane may be sent back to the fuel tank 102 with the bulk fuel. The bulk fuel comprising this retentate stream may be directly utilized by the main combustion engine. This approach allows the extraction of the low-sulfur clean, fuel stream 122 but also returns the sulfur compounds to the primary fuel stream instead of absorbing them or destroying them in the regeneration cycle.

Current conventional fuel handling systems and processes merely strip solid contaminants and water from the bulk fuel. The presently contemplated system 100 is much more refined, delivering low sulfur content clean fuel, rather than simply removing contaminants such as biomass, water, and debris from the bulk fuel typically found in ocean-going vessel fuel tanks that use seawater for ballast as fuel is used from the bulk fuel tanks.

Other uses of such an onboard system as described include:

Use of the clean fuel for non-propulsion applications such as auxiliary power systems that utilize or include utilization of fuel cell systems or other devices that require clean fuel at any time or location;

Storage of the low-sulfur fuel onboard the vessel or craft until the vessel or craft is in proximity to a populated area or as needed;

Utilization of the low-sulfur fuel while the vessel or craft is operating in a populated area or as needed;

Switch from "parent" fuel use to "clean" fuel use can be effected using GPS or other automated and/or remotely controlled mechanisms;

Use of above methodology for other mobile applications such as aircraft;

Supply/transfer of high-value "clean" fuel to other fuel containers, while the ship is at port for off-board applications that require "clean" fuel; and On-site production of high value "clean" fuel from crude oil harvested from off-shore rigs.

In the discussion that follows, the terms used are used according to their plain meaning as intended by a person skilled in the art. In the described embodiments below, the terms below are intended to be used as follows.

The term "hydrocarbon" is generally used to describe an organic compound primarily composed of hydrogen and carbon atoms of various lengths and structures but may also contain non-carbon atoms (such as oxygen, sulfur, or nitrogen).

The term "straight chain hydrocarbon" implies that the compound is a paraffin or isoparaffin type hydrocarbon without ring structures.

The term "pervaporation" means separation of mixtures of liquids by partial vaporation through a non-porous membrane.

The term "naphthenes or naphthenic compounds" are hydrocarbons with one or more rings of carbon atoms with only single bonds.

The term "aromatic compound" is a hydrocarbon containing one or more rings of carbon with double bonds within these rings.

The term "heterocyclics" are aromatic or naphthenic compounds that contain atoms in addition to carbon and hydrogen such as sulfur, nitrogen or oxygen. Heterocyclics are usually polar in nature.

The terms "polar" or "ionic", as referred to membranes, indicates membranes that contain ionic bonds. Similarly, the terms "non-polar" or "non-ionic" are membranes that do not contain ionic bonds. If the membrane is polar in nature or coated with a polar material such as a fluorinated polymer with branched sulfonic acid groups, e.g., NAFION®, the compounds with polar species will tend to be selectively transferred through the membrane. Non-polar membranes, such as cellulose triacetate, will tend to be selective to non-polar compounds and selectively decrease the transfer rate of ionic compounds.

The present disclosure relates to a pervaporation membrane process and system for separating a slip stream or auxiliary fuel stream from a primary fuel stream. It should be appreciated that for simplicity and clarity of illustration, elements shown in the Figures and discussed below have not necessarily been drawn to scale. For example, the dimensions of some of the elements are exaggerated relative to each other for clarity. Further, where considered appropriate, reference numerals have been repeated among the Figures to indicate corresponding elements.

Figure 2:
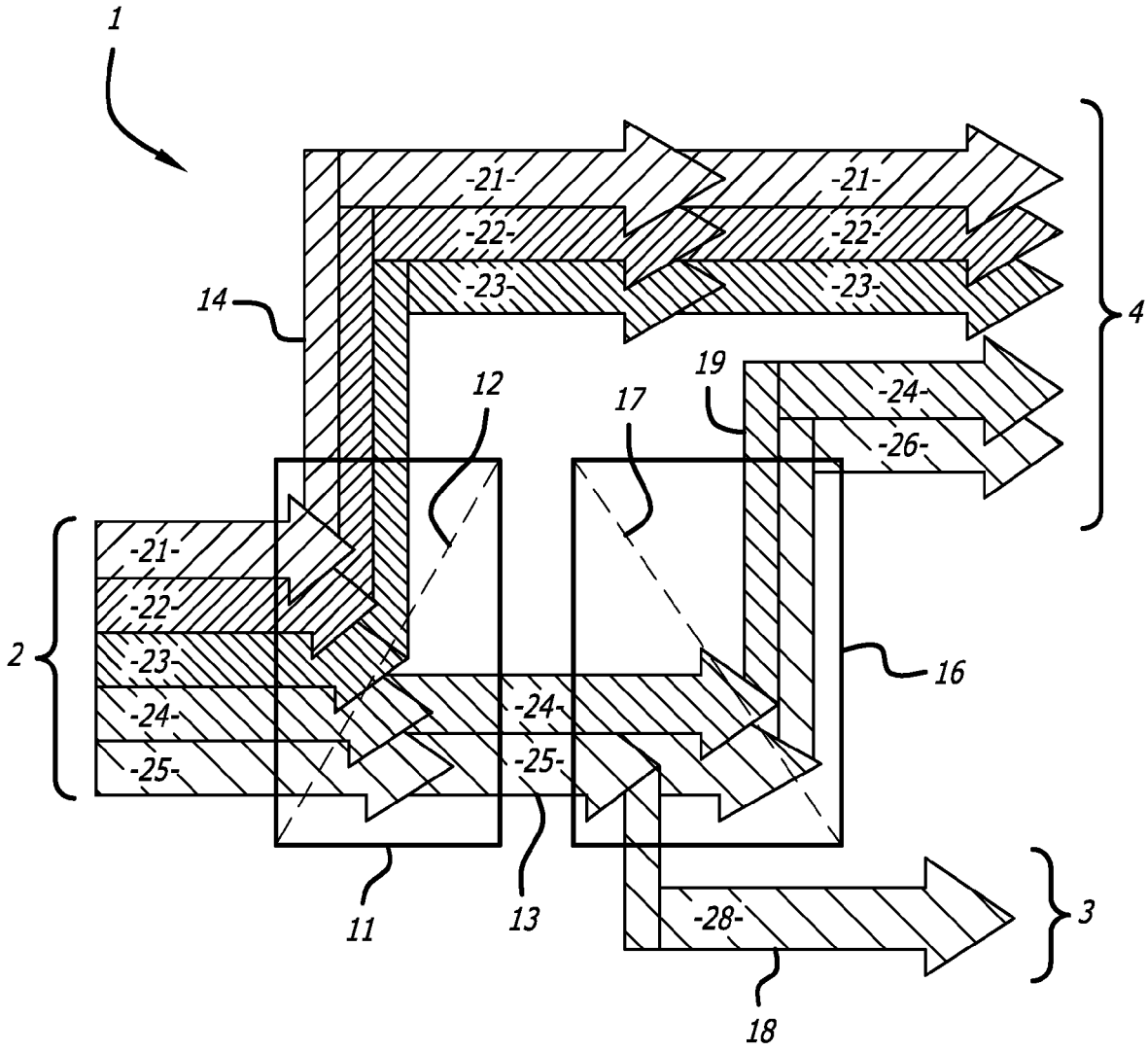
FIG. 2 is a simplified schematic flow diagram of a single separation stage system for a marine vessel, aircraft or land vehicle.

FIG. 2 shows a simplified schematic representation of another exemplary overall system and process according to this disclosure, indicating two separation stages and the selectivity for the various elements of the fuel feed mixture. The process 1 comprises flowing a portion of a primary bulk fuel stream 2 through a stage-one separator 11 and then flowing a separated portion 13 through a stage-two separator 16. The primary bulk fuel 2 can be any commercially available transportation or logistics fuel (such as, but not limited to, reformulated gasoline, kerosene and diesel commonly available at interstate refueling stations, jet fuels, aviation kerosenes (A-1) or military specification fuels like JP-8, NATO F-76, etc.) These bulk fuels, and bulk fuels obtained from unrefined and unregulated sources, consist of a wide mix of hydrocarbon components. As a result, each mixture has a range of compounds that each vaporize over a defined temperature band. In general, gasoline contains lighter components than kerosene, which in turn is lighter than diesel fuels. Within each volume of fuel of a specific type there exists a range of compounds with various vapor pressures and polar and non-polar characteristics.

The primary bulk fuel feed 2 is in particular composed of a mixture of components that can, in particular, consist of a mixture of hydrocarbons that can be subdivided into five primary groupings. The first group is the heavy sulfur compounds (H Sulfur) 22, which are the multi-ringed and multi-branched hydrocarbons with relatively high boiling points. For example, these include the di-benzothiophenes with boiling points greater than 300° C. Di-benzothiophenes contain at least three ring structures and are aromatic compounds. The second group is the light sulfur compounds (L Sulfur) 24, which are the simpler compounds containing sulfur with relatively lower boiling points and less than three ring structures. For example these include the various as mercaptans, thiophenes, and benzo-thiophenes with boiling points less than 300° C., and more preferably below 225° C. The third group is the heavy hydrocarbons (H HC) 21, and the fourth is the light hydrocarbons (L HC) 25, neither of which contain sulfur atoms, which were included in the first two groups. The fifth group is the additives 23, which are specific to each type of fuel depending on the manufacture, the manufacturer, and other criteria.

For example, military JP-8 fuel is similar to commercial aviation fuel except that three additives are required in the specification. For JP-8 these are fuel system icing inhibitors (MIL-DTL-85470) di-ethylene glycol monomethlylether (di-EGME), corrosion inhibitor/lubricity improvers (MIL-PRF-25017 and Paradyne 655) and electrical conductivity/static dissipater (Stadis®450 and MIL-S-53021).

In the process 1 shown in FIG. 2, the primary fuel feed 2 is separated into an auxiliary fuel stream 3 and a return primary fuel stream 4 in a multi-stage process 1 consisting of a stage-one separation process 11 and a stage-two separation process 16. In many vehicle applications, such as an ocean-going marine vessel, only a stage one separation process 11 may be needed to process fuel to the required low sulfur content level needed to meet environmental regulations in or when approaching a port. On the other hand, such a vessel may also include a second stage process 16 to further cleanse fuel for additional uses requiring much more stringent levels of sulfur compounds. Accordingly, the description that follows includes both a first and second stage of separation so as to cover all such embodiments. It is to be understood that if only a first separation stage is needed, then the stage-one permeate 13 will be utilized as the clean fuel. If even cleaner fuel is needed, then the stage-one permeate 13 may be further refined in the stage-two separation process described below.

The stage-one separation process 11 supports the transfer through a membrane 12 of the lighter compounds consisting of the light sulfurs 24 and the light hydrocarbons 25, which exit as the stage-one permeate 13. The other compounds 21, 22, and 23 are retained in retentate stream 14 also resulting from the stage-one separation process 11. The stage-one permeate 13 is either stored for use as clean stage-one fuel or is passed to the stage-two separation process 16. In the stage-two separation process, light sulfur compounds 24 are selectively transferred through membrane 17 along with some of the light compounds 26 as stage-two permeate 19 while most of the lighter hydrocarbons 28 are retained in stage-two retentate stream 18. The stage-two permeate 19 is mixed with the stage-one retentate 14 and returned to the primary application or bulk tank as the return primary fuel stream 4. Alternatively, the stage-two permeate 19 may be returned to the stage-one fuel storage tank if provided. The stage-two retentate 18 becomes the stage-two clean fuel supply 3.

Although the stage-one 11 and the stage-two 16 processes are selective processes, their selectivity is not necessarily absolute. By controlling the temperature of the feed streams 2 and 13 and the vacuum of the permeate streams 13 and 19, the quantity of compounds actually transferred through the membranes 12 and 17 can be controlled.

The motive force for permeation is the partial pressure difference (PPD) of the compounds passing through the membranes in each stage. The permeation rate is enhanced as the temperature increases. Temperature limitation of the membrane materials may suggest a lower operating point, but applying a vacuum in the permeate side would give higher PPD motive force to compensate for the lower temperature. As the temperature of the feed stream is increased, the mobility of the compounds is increased and permeability of the membrane is increased. Both parameters increase the rate of transfer of compounds through the membrane. The temperature of the membrane also increases the vapor pressure of compounds exposed to the permeate side of the membrane.

In a process 1 using pervaporation membranes, a vacuum in a range of 1 to 500 torr, and more preferably between 100 torr to about 200 torr, may be applied to the permeate side and the compounds with the highest vapor pressure are evaporated from the surface of the membrane as a vapor. The optimal temperature range depends on the level of vacuum, the type of primary fuel, and the membrane material that is utilized. For example, where the primary fuel is an aviation kerosene and the light hydrocarbon cut from the stage-one process 11 is in the gasoline boiling range, and a vacuum is applied across the membrane, then the temperature range should be between about 100° C. and about 200° C., with a preferable range between about 120° C. to 135° C. when a vacuum of 100-200 torr is applied. If, on the other hand, the primary bulk fuel is a diesel cut, then the temperature may be in the 150° C. to 300° C. range. The evaporation of the compounds with the highest vapor pressure creates a concentration gradient across the membrane, which promotes the enhanced transfer of these compounds from the feed stream. Compounds with low vapor pressures do not evaporate and therefore, a concentration gradient is not established for these compounds and additional transfers do not occur. Other parameters such as the membrane surface area, membrane thickness, and internal fluid phase mixing on the retentate side of the membrane also contribute to the quantity of compounds transferred. Increases in membrane surface area provide enhanced transfer because of the larger area for transfer and the larger evaporative transfer area on the permeate side. Thinner membranes have lower resistance for transport and support higher transfer rates because the concentration gradient that is established functions over a shorter distance.

The permeate flux is inversely proportional to the membrane thickness and hence a thinner membrane is preferred if it can survive at the operating pressure and temperature. Internal fluid phase mixing enhances transfer rates by ensuring mixing of the various compounds in the feed stream and maintaining the highest concentration of high vapor pressure compounds possible at the feed surface of the membrane. The mass transfer resistance in the bulk flow on the retentate side may reduce the effective partial pressure at the membrane surface. Turbulent flow or high flow velocities can improve mixing and increase flux. Adjusting these characteristics of the membranes in stage-one separators and stage-two separators help ensure that all of the light sulfur compounds 24, which are transferred in stage one 11 are again transferred in stage two 16. By operating at low enough temperatures where higher boiling compounds do not vaporize, the amount of heavy aromatics or multi-ring sulfur compounds such as the di-benzothiophenes going through into the permeate can be reduced and minimized.

The stage-one separation process 11 and stage-two separation process 16 in accordance with the present disclosure can be carried out utilizing a number of techniques ranging from flash vaporization separation (FVS), use of filtration membranes such as reverse osmosis (ROM), nanofiltration membranes (NFM) and ultrafiltration membranes (UFM) to pervaporation membranes such as non-polar pervaporation membranes (NPVM) and polar pervaporation membranes (PPVM). Proper selection of the specific separation technique for each stage is dependent on the specific primary fuel and the distribution of sulfur compounds within the mixture. The specific additives 23 and sulfur compounds in the primary fuel feed 2 can also influence the selection of which separation technique is optimum.

In one embodiment of a system in accordance with the present disclosure, a flash vaporizer equipped with a fractional distillation unit is used as the first stage, and polar pervaporation membrane is used in the second separation stage. In another embodiment, polar pervaporation membranes are used to perform both the first and second stage separations. These PPVMs combine the physical filtration and polar selectivity to preferentially isolate polar compounds of small size, and then apply additional selectivity because the transferred compounds are vaporized from the permeate side of the membrane. If a compound physically can transfer through the membrane, but its vapor pressure is too low at the operating temperature to be vaporized, it will not be carried over to the permeate phase. Therefore, a PPVM separator operating at a defined temperature can demonstrate selectivity to both light hydrocarbons and light sulfur compounds.

In another embodiment of the system in accordance with the present disclosure, the stage-two separator has a greater selectivity to polar molecules than the stage-one separator. This characteristic helps ensure that all polar sulfur compounds and other ionic compounds, which transfer through the first membrane, are returned to the primary fuel by way of the second stage permeate flow.

An exemplary embodiment of the process is designed to provide a low-sulfur, clean fuel stream usable in an auxiliary power unit (APU) onboard a vehicle by extracting a fraction of the fuel being sent to the primary application, such as to drive the engine or primary generator. An important parameter in the evaluation of the efficiency of the process is the ability to extract a low sulfur fraction of the fuel mixture while leaving behind substantially all of the fuel's performance additives and sulfur compounds in the return primary fuel stream.

Figure 3:
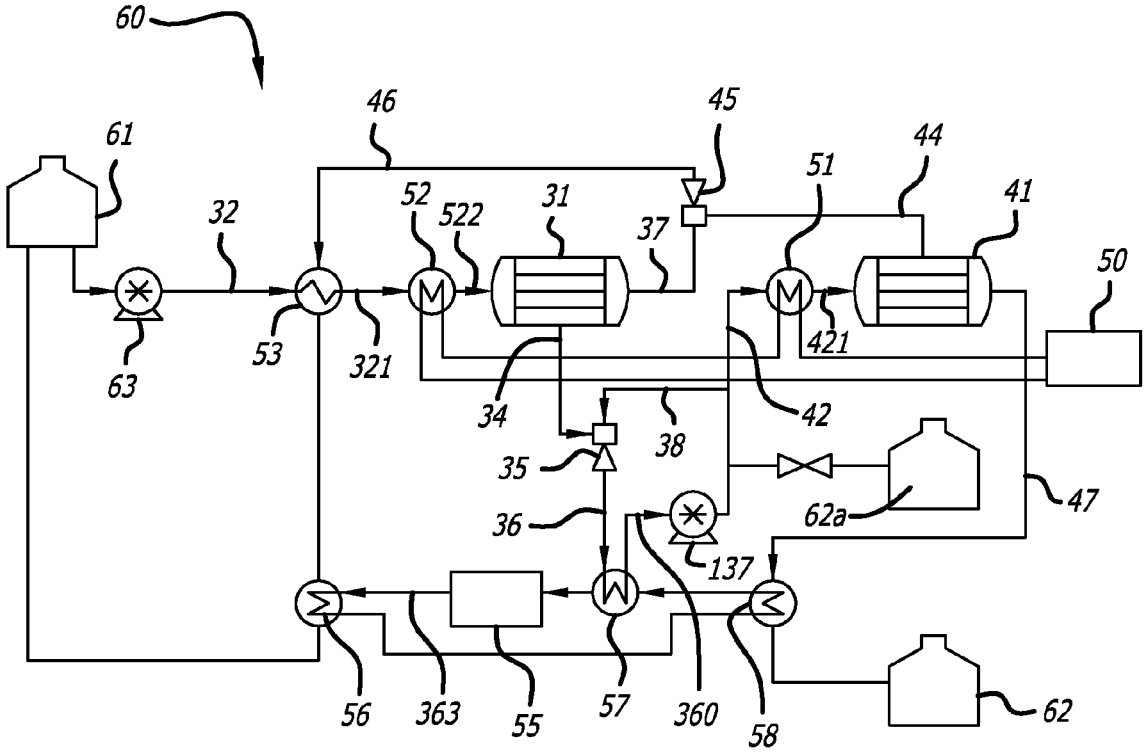
FIG. 3 is a simplified schematic flow diagram of a two separation stage system for a marine vessel, aircraft or land vehicle.

FIG. 3 shows an embodiment of the two stage process 1 of FIG. 2 implemented in a system 60. In the system 60 primary fuel from bulk tank 61 is pressurized by pump 63 in a primary fuel feed stream 32. The primary fuel feed stream 32 is then heated by process recuperative heat exchanger 53 to a primary fuel first hot feed stream 321. The primary fuel first hot feed stream 321 is then heated by hot engine fluid 50 in heat exchanger 52 to a primary fuel second hot feed stream 322. This second hot feed stream 322 is then fed to stage-one separator 31 in which it is separated into stage-one retentate stream 37 and stage-one permeate stream 34. The stage-one permeate stream 34 is then conveyed into eductor 35 which is driven by eductor's motive fluid 38. In eductor 35, the stage-one permeate vapor stream 34 is put at vacuum, where the vacuum is due to the feed stream of eductor motive fluid 38. Exiting the eductor 35 is the combined liquid stream 36, which is a mixture of the stage-one permeate stream 34 and the eductor motive fluid 38. This combined liquid stream 36 flows to cooling heat exchanger 57 where it is cooled. The weight ratio of the cool motive liquid 38 to the stage-one permeate vapor 34 is kept suitably high such that the condensation heat raises the temperature of the combined liquid stream 36 only slightly. The condensation of vapor into liquid results in lower volume and thus a vacuum is created upstream. The use of an eductor with high velocity motive fluid also creates a vacuum.

The hot liquid stream 36 is cooled in the heat exchanger 57 into a cool liquid stream 360, which is increased in pressure by pump 137 and splits into motive stream 38 sent to eductor 35 and stage-two feed stream 42. A portion of the stage-two feed stream 42 may be directed to an intermediate clean fuel storage container 62*a*. The clean fuel stored in intermediate container 62*a* may be utilized wherever environmental restrictions permit such fuel to be used in the combustion engine. Cooling unit 55 is a heat rejection element consisting of an air-cooled or liquid-cooled radiator or other appropriate mechanism such as the vehicle's air conditioning system through which excess heat can be removed from the system. Cooling fluid streams 362 and 363 are cooling loops conceptually illustrated to transfer heat from the three cooling heat exchangers 56, 57, and 58 to the cooling unit 55. Although a series flow configuration is shown in the disclosure, it is not limited by this illustration and any combinations of series or parallel flows and integrated or dedicated cooling units are feasible and covered in this disclosure. The recuperative heat exchanger 53 transfers the heat from return fuel stream 46 to the feed stream 32. To ensure that all the vapor in the return stream 46 is condensed cooling heat exchanger 56 is included.

A portion of the liquid stream 361 is passed onto stage-two separator 41 as the stage-two feed flow 42. In the embodiment shown in FIG. 3, only a small part of the liquid stream 361 is passed onto the stage-two separator 41, while the most part flows to the eductor as the eductor motive fluid 38. The use of the liquid stream 361 as eductor motive fluid 38 eliminates the necessity of using a separate working fluid with its gas-liquid separators and dual downstream cooling heat exchangers. In steady state operations, the composition of the gas-liquid stream 36 is primarily the light hydrocarbon and light sulfur compounds as discussed in more detail below. In steady-state operation the composition of fluids 34, 36, 38 and 361 are the same that support the direct condensation of gas-liquid stream 36 after it exits the eductor 35.

The stage-two feed 42 is passed to re-heat heat exchanger 51 and becomes a hot stage-two feed 421 that enters stage-two separator 41. The feed stream of the hot stage-two feed 421 is separated into stage-two permeate stream 44 and stage-two retentate stream 47. The stage-two feed 42 may, in some alternative embodiments, first be heated through recuperative heat exchangers (not shown) interfaced with the outlet streams from stage two, either the stage-two permeate 44 or stage-two retentate 47 prior to entering the re-heat exchanger 51. The sulfur selectivity of the membrane in the stage-two separator 41 supports the transfer of a majority of the sulfur compounds in the stage-two permeate stream 44 while maintaining some of the light hydrocarbon compounds as the stage-two retentate stream 47, which is cooled and stored in tank 62 as the auxiliary fuel supply. The better the selectivity of the stage-two membrane the more light hydrocarbons are retained in the retentate stream 47. The stage-two permeate stream 44 is put at a vacuum due to the action of a motive fluid conveyed into eductor 45. In this embodiment, the motive fluid for the eductor 45 is stage-one retentate stream 37. In another alternative, the stage-two feed 42 can be heated with one or more regenerative heat exchangers interfacing with the stage-one retentate stream 37.

Use of the stage-one retentate stream 37 to drive the eductor 45 minimizes the complexity of the process. Exiting from the eductor 45 is the returning fluid 46 passing through the recuperative heat exchanger 53 to improve process thermal efficiency. The fluid is finally passed through the cooling heat exchanger 56 before returning to the tank 61 to ensure the returning fluid is at or near ambient temperature.

One or both of the permeate streams may also be cooled in one or more separate cooling heat exchangers to enhance vacuum creation. In other embodiments, the stage-one retentate stream 37 is cooled prior to functioning as the motive fluid for the eductor 45. For example the eductor 45 can be positioned downstream of the recuperative heat exchanger 53 such that the retentate stream 37 flows through the heat exchanger 53 prior to entering the eductor 45 as the motive fluid. In this embodiment, the motive fluid for the eductor 45 is the stage-one cooled retentate stream 37. In another embodiment, one or both of the permeate streams are also cooled in one or more separate cooling heat exchangers to enhance vacuum creation.

In other embodiments, exiting from the eductor 45, the sulfur compounds transferred as permeate in the stage-two separator can be mixed with the retentate from stage one and returned to the primary engine or the primary bulk fuel tank 61.

The system disclosed above can be used to perform a multi-stage separation process onboard a vehicle to extract a low-sulfur slip stream, in the stage-two retentate 47 of fuel compounds, which can be used for auxiliary power units, while designing the separation stages such that performance-enhancing additives in the primary bulk fuel 32 are retained in the stage-one retentate 37 or returned to the stage-one retentate by way of the stage-two permeate 44.

This approach allows the extraction of a low-sulfur, clean fuel stream by way of a multi-stage process returning the sulfur compounds in the residue to the primary bulk fuel tank 61 instead of adsorbing or absorbing them into a throw away filter or a bed of solids and destroying the sulfur compounds in the regeneration cycle. This approach also enhances the performance of third stage adsorbents or absorbents, because the other polar compounds in the fuel are also reduced in concentration by the first two stages. Adsorbent storage capacity with the most commonly used fuels was found to be one-tenth their capacity in comparison to surrogate fuels which have been doped with specific sulfur compounds. This drop in capacity is due to other compounds such as additives or heavy aromatics, which are also polar in nature occupying active sites for adsorption.

One embodiment of the system focuses on using the retentate 37 from stage one as the motive fluid for the stage-two eductor 45 that provides the vacuum on the stage-two permeate side. This retentate stream can be cooled to enhance the performance of the eductor creating greater vacuum on the stage-two permeate side. Similarly, the evaporated permeate stream 44 can also be cooled and condensed prior to entering the eductor 45 to further enhance performance. Also the stage-one retentate 37 can be cooled prior to entering the eductor to further enhance vacuum performance. Cooling of these fluids around the eductor can be through direct cooling or recuperative cooling in combination with preheating feed streams to the stage-one or stage-two membrane processes.

One embodiment of the system focuses on using the stage-one permeate stream 34 after condensation and pressurization as the motive fluid 38 for the stage-one eductor 35. Another embodiment of the system focuses on the returning fluid 46 passing through the recuperative heat exchanger 53 to improve process thermal efficiency. The fluid is then finally passed through the cooling heat exchanger 56 before returning to the tank 61 to ensure the returning fluid is at or near ambient temperature.

One embodiment of the system includes the use of the thermal energy from the primary engine application to provide the peak thermal energy need for effective operation of the stage-one and stage-two separator modules. This is illustrated in FIG. 3 with an engine 50 and heat exchangers 51 and 52.

Another embodiment of the system process includes further integration with the primary vehicle. In this embodiment, the cooling loop source 55 is integrated with the vehicle's cabin air conditioning system to minimize component redundancy. Depending on the primary fuel type (such as JP-8, diesel, or gasoline) the vapor pressure of the light compounds in the stream 34 and the pressure of the mixed stream 36 the temperature needed to fully condense the mixed stream 36 into the liquid stream 361 may be less than ambient temperatures. In this situation the cooling loop element 55 may be integrated into the vehicle's air conditioning loop which has been designed to cool the cabin air. Alternatively, a dedicated cooling unit capable of sub-ambient temperatures may be used as a cooling element 55.

Figure 4:
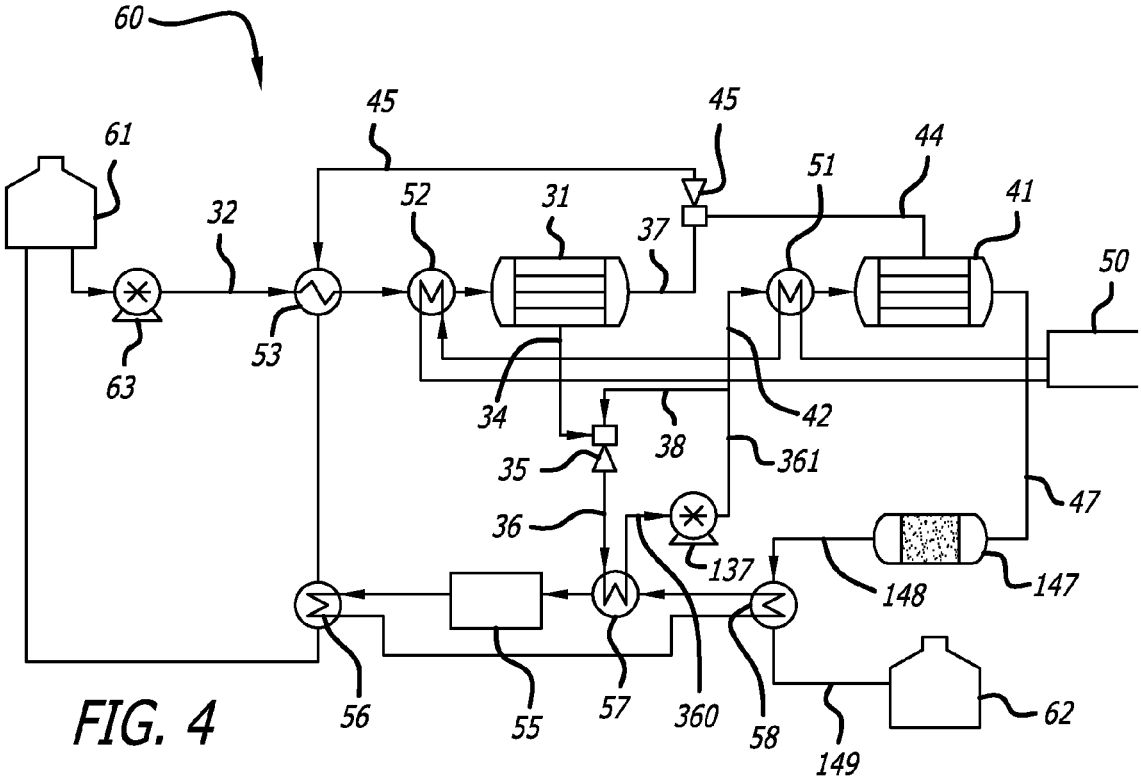
FIG. 4 is a simplified schematic flow diagram of another embodiment of the system in accordance with the present disclosure.

Further embodiments of the process and system can include the addition of this third stage adsorbent or absorbent module to polish the final auxiliary fuel stream. FIG. 4 shows an exemplary implementation of such embodiments. With reference to FIG. 4, the system is identical to that of FIG. 3 except that a sorbent-type polishing filter bed 147 is added to the process system in the stage-two retentate stream 47. If the down stream applications for the slip stream require very low sulfur concentrations then the polishing filter bed 147 is added. Sulfur compounds in the stage-two retentate are trapped in the sorbent-type bed such that stream 148 leaving the bed 147 has very low sulfur concentrations.

The polishing filter bed 147 may be an adsorbent similar to high surface area carbon or carbon with specific surface modifications tailored to adsorbing the polar sulfur compounds. The bed 147 may be an absorbent or reagent designed to react with the sulfur atom in the compounds resulting in a non-soluble sulfur inorganic salt that is trapped in the bed.

In summary, the present disclosure relates to a multi-stage process for the separation of a slip stream of fuel with low-sulfur concentration from a primary multi-component fuel stream. The primary multi-component fuel is fed to the first stage in which a slip stream is isolated containing lighter components and the heavier components are retained in the retentate stream. The lighter component slip stream is further processed by the second-stage membrane in which the sulfur components of the slip stream are selectively removed from the feed as second-stage permeate and a second-stage retentate is recovered as the low-sulfur auxiliary fuel supply.

In another aspect, the disclosure relates to a multi-stage process in which one or more of the stages are a selective membrane, and most specifically a polar or ionic pervaporation membrane, which has been designed to have selectivity for lighter sulfur compounds. Polymeric membranes such as NAFION® (DuPont) and specially treated polyimides such as S-Brane (W. R. Grace) are examples of sulfur selective polar pervaporation membranes.

In another aspect, the disclosure relates to a multi-stage process in which one or more of the stages are a non-selective, high flux membrane. As with other preferred embodiments the stage-one permeate 34 is condensed and fed to a second-stage membrane process 41. The high flux membrane is selected when the relative sulfur in the light fraction is less than 100%, as has been validated for some Jet-A type fuels.

As with any evaporation, distillation, or pervaporation process the species evaporating from the bulk fluid is driven by the vapor pressure of the individual species at the liquid gas phase interface established within the membrane. The vapor pressures of the individual species are strongly dependent on the temperature, but all species have some finite vapor pressure, and therefore, as the light fractions evaporate trace amounts of the heavier species also evaporate. Depending on the specific sulfur compound species in the bulk fuel and the trace levels of these species in the stage-one permeate 34 further refinements to the stage-one process may be needed to achieve an overall effective system.

Another preferred embodiment of the system divides the stage-one process into a stage-1A and stage-1B process. Both stage-1A and stage-1B are pervaporation, flux membrane, distillation, and/or evaporation type processes. The permeate 34 stream for the stage-1A is condensed, reheated and sent as the feed stream to the stage-1B process. The permeate stream for the stage-1B is condensed and sent to the stage-two process as previously described. This secondary stage-one process helps to enhance the selectivity through dual filtering of the trace species. The retentate streams from both the stage-1A and stage-1B are returned to the primary fuel tank.

Figure 5:
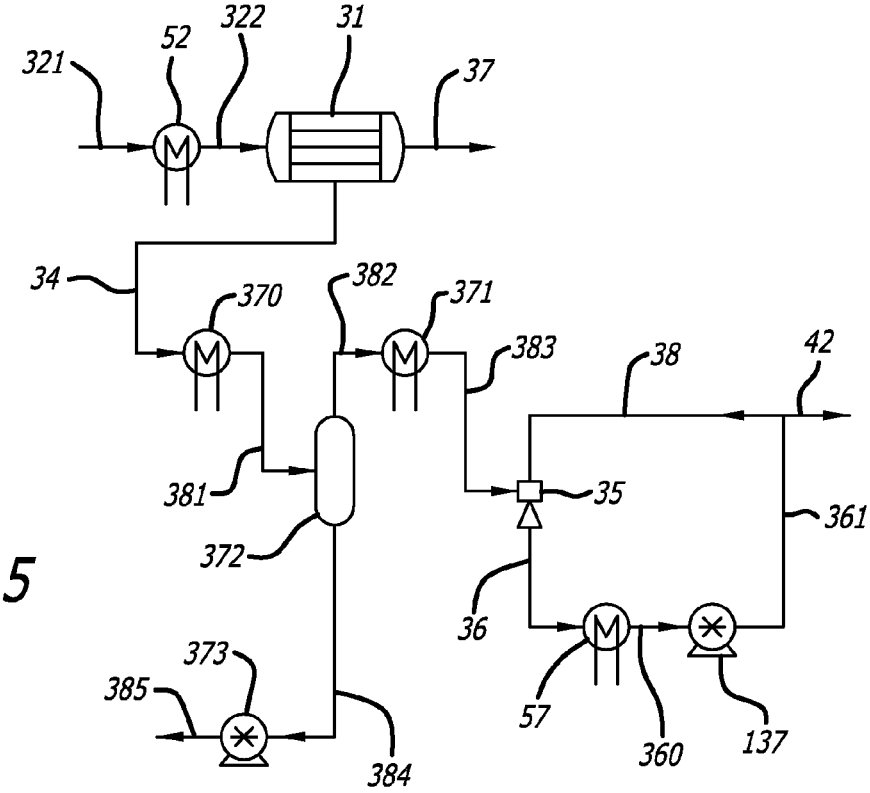
FIG. 5 is a partial schematic flow diagram of the stage-one portion of another embodiment of the system in which a two step condensation function is used on the stage-one permeate.

Another exemplary embodiment of the system in accordance with the present disclosure addresses the issue of trace amounts of heavier species in the stage-one permeate 34. In this embodiment a two-step condensing function is integrated into the process after the stage-one permeate stream 34 is created. FIG. 5 illustrates one preferred embodiment of this condensing function configuration applied to the systems shown in FIGS. 3 and 4. Here, like numbers are used to designate like elements previously discussed with reference to FIGS. 3 and 4.

The stage-one permeate 34 is passed through a partial condenser 370 in which the heaviest species are converted into liquid creating a two phase flow 381. The two phase flow 381 is passed into a gas-liquid separator 372 creating a liquid stream 384 and a vapor stream 382. The liquid stream 384 is returned to the primary tank 61 using a pump 373 and a return connection 385. The vapor stream 382 is condensed in a heat exchanger 371 and passed to the eductor 35 by way of connection 383. The process down stream of the eductor 35 is similar to other embodiments of the system described above with reference to FIG. 3.

The multi-stage process in accordance with the present disclosure may be configured to have the pressurized retentate stream for the first stage flow through the motive side of an eductor to create a vacuum on the permeate side of the second stage. In this configuration all permeate compounds are returned to the primary fuel stream and the process is further simplified by eliminating the requirement for vapor liquid separation hardware. Enhancements of this process and system can include the cooling and/or condensation of the feed streams into the eductor 45 to improve the vacuum performance creating a lower pressure for the stage-two permeate stream 44. This cooling function can be direct, through the integration of a heat exchanger connected to the cooling system 55, or can be achieved with recuperative heat exchangers interfaced with other streams such as the stage-two feed stream 42 prior to heating by heat exchanger 51, or with other streams such as the stage-one feed stream 321 prior to heating by the heat exchanger 52. Other thermal recuperation aspects and flow configurations are feasible to enhance process energy efficiency and the embodiments of this process are not limited by the configurations that have been illustrated for simplicity.

A multi-stage process in accordance with the disclosure may be configured such that the condensed permeate of the first stage flows through the motive side of an eductor to create a vacuum on the permeate side of the first stage. In this configuration the process is further simplified by eliminating the requirement for vapor liquid separation hardware. In yet another aspect, the disclosure relates to a multi-stage process in which the thermal energy in the mixture of the first stage retentate and the second stage permeate is recuperated and transferred to the first stage feed to minimize thermal energy requirements.

A multi-stage process in accordance with the disclosure may be configured such that the peak thermal energy is provided to the stages through integration with the reject heat from the primary engine in a vehicle. The thermal cooling energy may be provided to the stages through integration with the vehicle's vapor compression system typically used to condition the air within the vehicle's cabin.

In yet another aspect, the multi-stage process may be configured such that membrane systems are used to extract a low-sulfur slip stream, which is later used in a fuel cell or hydrogen generation system. For example, the initial stage membrane systems may also be integrated with a last polishing stage consisting of absorbent or adsorbent materials designed to extract the sulfur compounds to levels below 10 ppm concentrations.

The following modeled examples are provided to describe the disclosure in further detail. These modeled examples, which set forth a preferred mode presently contemplated for carrying out the disclosure, are intended to illustrate and not to limit the disclosure.

Trucks and HUMVEE® type vehicles use varying quantities of diesel or logistic fuel (JP-8) depending on the speed, load being carried, and other parameters. Usually the main engine needs to operate even during non-drive time to supply heating or A/C or communication power needs. In order to improve the overall fuel efficiency and to reduce the times the main engine needs to be operated, the heating and air-conditioning and night-watch communication power may be supplied by a fuel cell operating on hydrogen that will be generated using a low-sulfur clean fuel (approximately 5 to 15% of the bulk fuel) separated from the primary fuel.

Making reference also to the diagrams illustrated in FIGS. 2, 3 and 4, primary fuel from the bulk fuel tank 61 having a sulfur content of 500 ppm is pumped to 100 psig and sent to the heat exchangers 53 and 52 where its temperature is raised to 250° C., and then fractionated, separated or partially vaporized in the unit 31 by letting down to ambient pressure. The vapor stream or permeate stream 34 is condensed (about 25% of feed by volume) by mixing in an eductor unit 35 with the condensed recycle stream 38. The condensed light hydrocarbon stream contains about 400 ppm by volume of sulfur but is free of additives and contains only trace amounts of higher boiling hydrocarbon components. Then the condensed light stream 42 is sent to an exchanger 51 and to the membrane separator 41, where it is split into a liquid retentate stream 47 and a vapor permeate stream 44, which is combined with the heavy stream 37 from unit 31 and returned back to the primary fuel tank as stream 45 containing about 550 ppm sulfur and all of the additives. The stream 47 contains less than 9 ppm sulfur and is the clean auxiliary fuel that is used in APU reformers (not shown here) for making syngas or hydrogen for use in fuel cells that produce electric power.

Currently commercial and civilian aircrafts have APUs that are generally 50 to 250 kW in size that use JP-8 fuel in combustion process at low efficiencies and producing pollutants even when they are on the ground. These APUs can be converted to low or non-polluting hydrogen-based fuel cells as discussed above, using stage two fuel generated from the bulk fuel in the aircraft.

Naval ships and merchant marine vessels can also be equipped with the auxiliary fuel production and reformers and fuel cells producing clean power while these ships are docked at port, as taught above, but at larger capacities 250 to 750 kW scales in addition to providing clean diesel fuel for use in or near port from the stage-one permeate.

Figure 6:
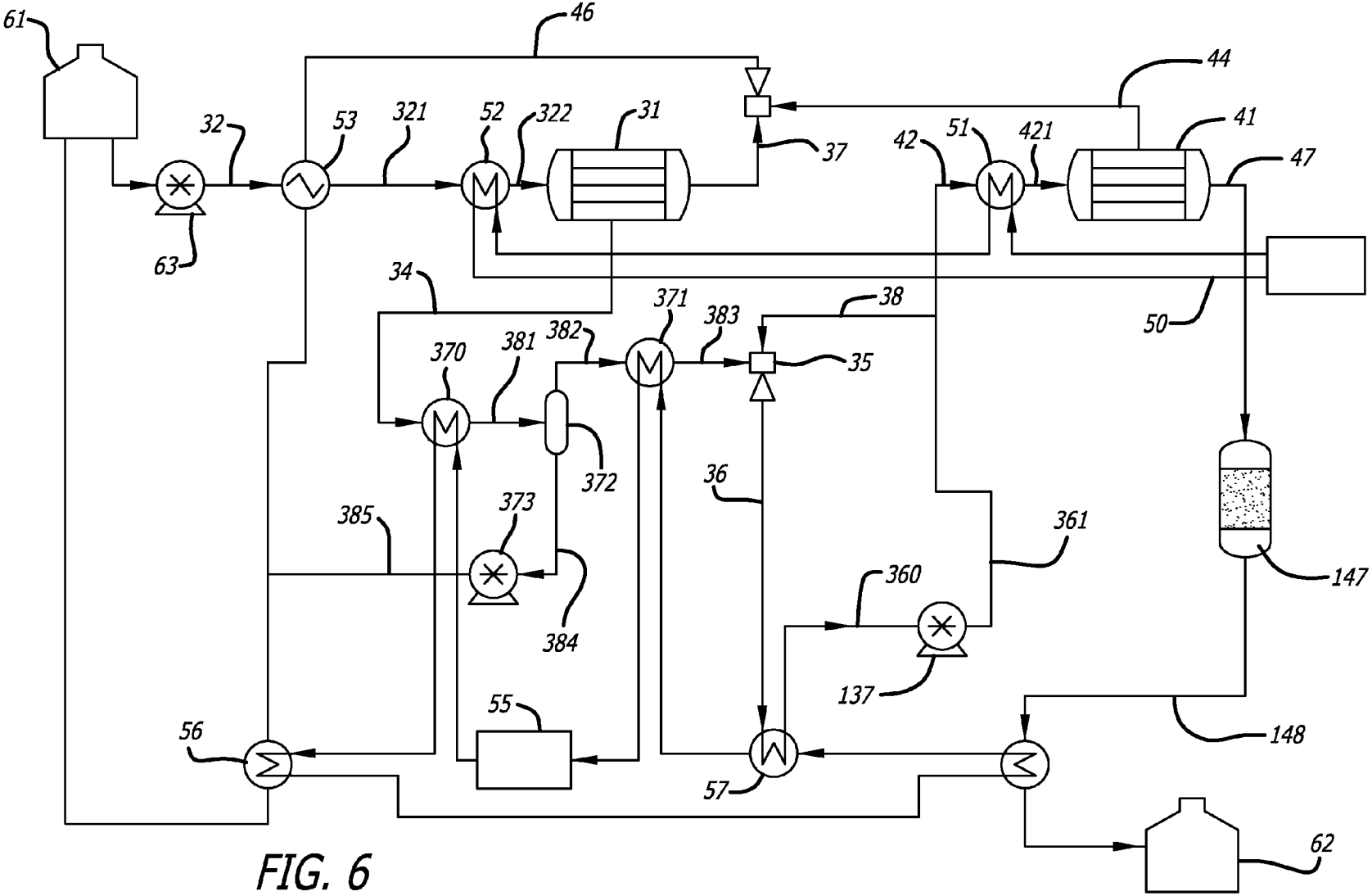
FIG. 6 is a schematic flow diagram of another embodiment of the system in accordance with the present disclosure.

An embodiment of the system 60, which utilizes two condensers in line with the stage-one permeate, is illustrated in FIG. 6. The primary fuel from the tank 61 is pressurized by the pump 63 in the primary fuel feed stream 32. The primary fuel feed stream 32 is then heated by the process recuperative heat exchanger 53 to a primary fuel first hot feed stream 321. The primary fuel first hot feed stream 321 is then heated by the hot engine fluid 50 in the heat exchanger 52 to the primary fuel second hot feed stream 322. This second hot feed stream 322 is then fed to the stage-one separator 31 in which it is separated into the stage-one retentate stream 37 and stage-one permeate stream 34. The majority of the sulfur compounds are retained in the retentate stream 37 because, typically, a majority of the sulfur compounds are heavier than the light fractions isolated as the stage-one permeate stream 34. This stage-one permeate stream 34 in the vapor state can be treated by polishing filter. The polishing filter may contain a catalyst where the sulfur compounds are selectively converted to $H_2S$ or $SO_2$ and $SO_3$ by adding either $H_2$ gas or air respectively to increase the selectivity of the absorption bed portion of the polishing filter or to enhance condensation in the first partial condenser. The catalyst system can be heated to temperatures of 100° C. to 350° C. to improve reactivity.

The stage-one permeate stream 34 is then cooled by the heat exchanger 370 only partially such that only the heaviest of compounds are condensed and the lightest compounds remain in the vapor state so that the permeate stream 381 is part vapor and part liquid. This stream enters a separator 372 in which the liquid phase or heavier compounds exit as liquid condensate stream 384 and the vapor phase or lightest compounds exit as vapor stream 382. The lightest compounds in the vapor 382 are further cooled in the heat exchanger 371 until all of the components are condensed and exit as a liquid stream 383. This vapor stream 382 can be treated by passage through a polishing filter prior to entering the second partial condenser 371. The polishing filter may contain a catalyst where the sulfur compounds are selectively converted to $H_2S$ or $SO_2$ and $SO_3$ by adding either $H_2$ gas or air respectively to increase the selectivity of the absorption bed portion of the polishing filter. The catalyst system can be heated to temperatures of 100° C. to 350° C. to improve reactivity.

The liquid stream 383 is then conveyed into the eductor 35, which is driven by the eductor's motive fluid 38. In the eductor 35, the stage-one light condensate liquid stream 383 is put at vacuum, where the vacuum is due to the feed stream of the eductor motive fluid 38. Exiting the eductor 35 is the combined liquid stream 36, which is a mixture of the stage-one light condensate stream 383 and the eductor motive fluid 38.

This combined liquid stream 36 flows to the cooling heat exchanger 57 where it is cooled. The hot liquid stream 36 is cooled in the heat exchanger 57 into a cool liquid stream 360 which is increased in pressure by pump 137 and splits into the motive stream 38 sent to the eductor 35 and stage-two feed stream 42. The cooling unit 55 is a heat rejection element consisting of an air-cooled or liquid-cooled radiator or other appropriate mechanism such as the vehicle's air conditioning system through which excess heat can be removed from the system. The recuperative heat exchanger 53 transfers the heat from the return fuel stream 46 to the feed stream 32. To ensure that all the vapor in the return stream 46 is condensed, the cooling heat exchanger 56 is included.

A portion of the liquid stream 361 is passed onto the stage-two separator 41, as stage-two feed flow 42. In the embodiment shown in FIG. 6 only a small part of the liquid stream 361 is passed onto the stage-two separator 41, while the most part flows to the eductor as eductor motive fluid 38. The use of the liquid stream 361 as eductor motive fluid 38 eliminates the necessity of using a separate working fluid with its gas-liquid separators and dual downstream cooling heat exchangers. In steady state operations, the composition of the gas-liquid stream 36 is primarily the light hydrocarbon and light sulfur compounds as discussed in more detail below. In steady-state operation the composition of the fluids 383, 36, 38 and 361 are the same that support the direct condensation of the gas-liquid stream 36 after it exits the eductor 35.

The stage-two feed 42 is passed to re-heat the heat exchanger 51 and becomes a hot stage-two feed 421 that enters stage-two separator 41. The feed stream of the hot stage-two feed 421 is separated into the stage-two permeate stream 44 and a stage-two retentate stream 47. The sulfur selectivity of the membrane in stage-two separator 41 supports the transfer of a majority of the sulfur compounds in the stage-two permeate stream 44 while maintaining some of the light hydrocarbon compounds as the stage-two retentate stream 47. The stage-two retentate stream is passed through a sorbent-type polishing filter bed 147. Sulfur compounds in the stage-two retentate are trapped in the sorbent-type bed such that the stream 148 leaving the bed 147, which is then cooled and stored in tank 62 as the auxiliary fuel supply, has very low sulfur concentrations.

Polishing filters may optionally be located in the vapor-phase of the stage-one permeate stream, which may be heated to temperatures from 100° C. to 350° C. In one embodiment, the polishing filter may contain a catalyst where the sulfur compounds are selectively converted to $H_2S$ or $SO_2$ and $SO_3$ by adding either $H_2$ gas or air respectively, to increase the selectivity and absorption capacity. $H_2S$ or $SO_2$ and $SO_3$ are then adsorbed in the polishing filters.

Figure 7:
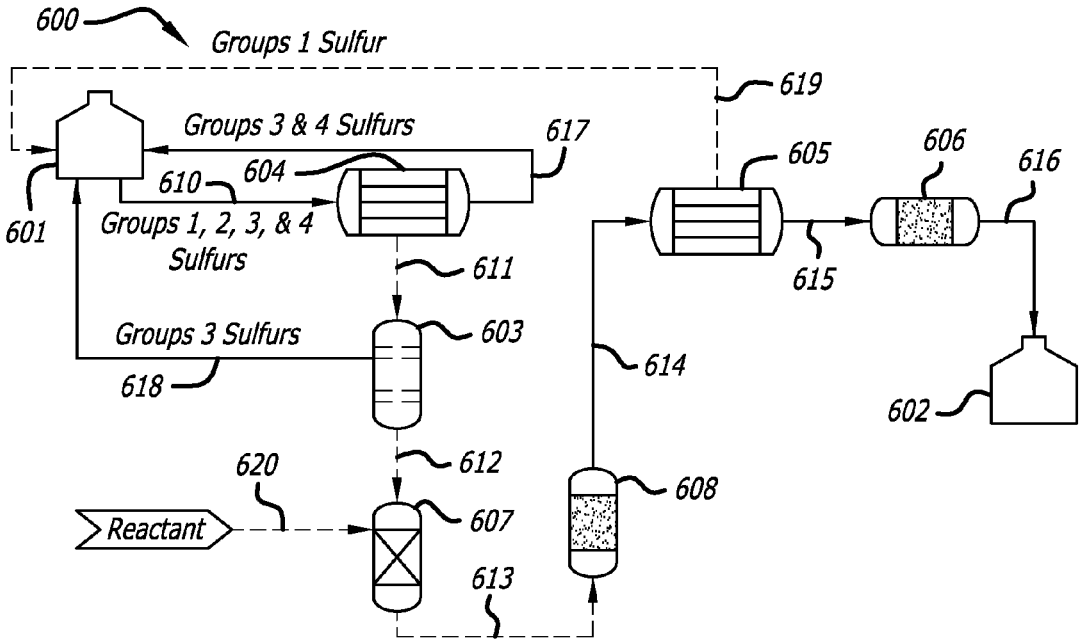
FIG. 7 is a simplified schematic flow diagram of another embodiment of the system in accordance with the present disclosure.

FIG. 7 provides a simplified conceptual flow diagram that outlines the overall scope of the innovative desulfurization process and system of the present disclosure. FIGS. 8, 10, 11, 12 and 19, in turn illustrate a number of different alternative implementations of the process and system of the present disclosure.

Turning now specifically to the simplified system 600 shown in FIG. 7, the solid lines between components represent liquid phase connections and the dashed lines represent vapor phase connections, while heat exchangers, coolers, and heaters have been omitted to simplify the schematic representation. The elimination of these potential thermal integration components is not intended to limit the overall scope of the disclosure, but simply to facilitate ease of explanation at this point.

Feed fuel supply contained in tank 601 is separated and conditioned by the innovative process of this disclosure into a low sulfur fuel for auxiliary applications. The processed low sulfur fuel is stored in tank 602. Conventional approaches use an adsorbent or absorbent fixed bed that removes the sulfur species and delivers the clean fuel, but with the high concentrations of sulfur species these fixed beds can be large and/or require frequent replacement or regeneration, making this simple process ineffective. The innovative process of this present disclosure gets around this inefficiency and ineffectiveness by selectively isolating specific sulfur species and returning them to the primary fuel tank 601 and/or reacting the non-isolated sulfur species so that they are easily isolated in downstream components.

In FIG. 7, liquid feed fuel from tank 601 is passed through connection 610 to a stage-one membrane separator such as separator 604. The low boiling point fuel is extracted as a vapor from the feed fuel and passed to downstream components for additional processing through connection 611. In this embodiment one of these downstream processes may be a vapor phase reactive desulfurization (RDS) catalyst reactor 607 followed by a secondary isolation component 608. The reactive desulfurization catalyst reactor 607 uses a reactant entering the catalyst 607 through connection 620. The reactant can be an oxidant such as oxygen, air, peroxide, steam, or other highly oxidative reactant that will provide oxygen atoms to the catalytic reactor 607. These RDS techniques are defined as oxygen desulfurization (ODS) techniques, in which the vapor phase sulfur species are oxidized to form compounds of $SO_2$ or $SO_3$ ($SO_{(x)}$) that are easily isolated on a sorbent bed(s). An example of a selective sulfur oxidation (SCO) catalyst is described by J. Lampert of Engelhard Corporation in *J of Power Sources*, Volume 131, Issues 1-2, 14 May 2004, Pages 27-34. The SCO catalyst is a precious metal catalyst supported on a honeycomb style monolith. The sorbent/trap for $SO_{(X)}$ is often mixed metal oxides in a single bed or in two consequent beds one for $SO_3$ and another for $SO_2$.

The reactive vapors can also be subjected to a reducing reaction using reactants such as hydrogen, or other highly reducing reactant. These RDS techniques are defined as hydro-desulfurization (HDS) techniques, in which the vapor phase sulfur species are reduced to form hydrogen sulfide or $H_2S$ that is easily isolated on a sorbent bed, made up of metal oxides such as Zinc oxide or mixed metal oxides such as CuO/ZnO/NiO or even transition metal impregnated activated carbon or zeolites such as TOSPIX94. Typical vapor phase HDS catalysts are Nickel-Molybdenum on alumina or Cobalt-Molybdenum on alumina.

The secondary isolation component can be a vapor phase sorbent bed 608 (adsorbent or absorbent) and/or a membrane separator 605 and/or a liquid phase sorbent bed 606 (adsorbent or absorbent) depending on the specific types of sulfur species in the feed mixture and depending on the specific types and quantities of sulfur species that are isolated in the stage-one permeate vapor phase 611 during the stage-one process. Each of these embodiments will be discussed in greater detail below.

In general and with respect to the sulfur species groupings defined in Table A below, the stage-one membrane process is designed to eliminate species in the heavier groups, for example groups 3, 4 and 5. Based on the feedstock characteristic (gasoline, kerosene, and/or diesel fuel cuts) in tank 601 and the mass flow ratio between stage one permeate 611 and the feed 610, the effectiveness of isolating all of groups 3, 4, and 5 will vary. The stage one membrane 604 is very effective at eliminating groups 4 and 5 sulfurs, but still has over 50 ppm of group 3 sulfurs. To eliminate these group 3 sulfurs a partial condenser 603 is placed down stream. As a result the isolated fuel in connection 612 has very few group 3 sulfurs and consists primarily of group 1 and 2 sulfurs.

TABLE A

Segregation of Sulfur Species and Compounds into Groups

| Sulfur Compounds | Group 1 | Group 2 | Group 3 | Group 4 | Group 5 |
|---|---|---|---|---|---|
| Mercaptans | X | | | | |
| Thiophene | X | | | | |
| MethylThiophenes | X | | | | |
| TetrahydroThiophene | X | | | | |
| C2-Thiophenes | X | X | | | |
| C3-Thiophenes | | X | | | |
| C4-Thiophenes | | X | | | |
| Thiophenol | | X | X | | |
| Methyl-Thiophenol | | X | X | | |
| Benzo-Thiophene | | | X | | |
| C1-Benzothiophenes | | | X | X | |
| C2-Benzothiophenes | | | X | X | |
| C3-Benzothiophenes | | | | X | |
| C4+-Benzothiophenes | | | | X | X |
| Di-benzothiophenes | | | | X | X |
| C2-Dibenzothiophenes | | | | | X |
| C3-Dibenzothiophenes | | | | | X |
| C4-Dibenzothiophenes | | | | | X |
| More Complex Species | | | | | X |

One approach would be to condense this vapor in connection 612 and process it by a second stage membrane reactor 605. Depending on the effectiveness of isolating the group 1 and 2 sulfurs in the stage two permeate 619 the final stage-three sorbent bed 606 can be effective and not require too frequent change outs or regeneration cycles. This approach is outlined in greater detail with the discussion around FIGS. 2-5 set forth above. If the stage-two membrane process is not effective enough at isolating group 1 and 2 sulfurs the alternative embodiment with the RDS catalyst 607 is needed.

Figure 8:
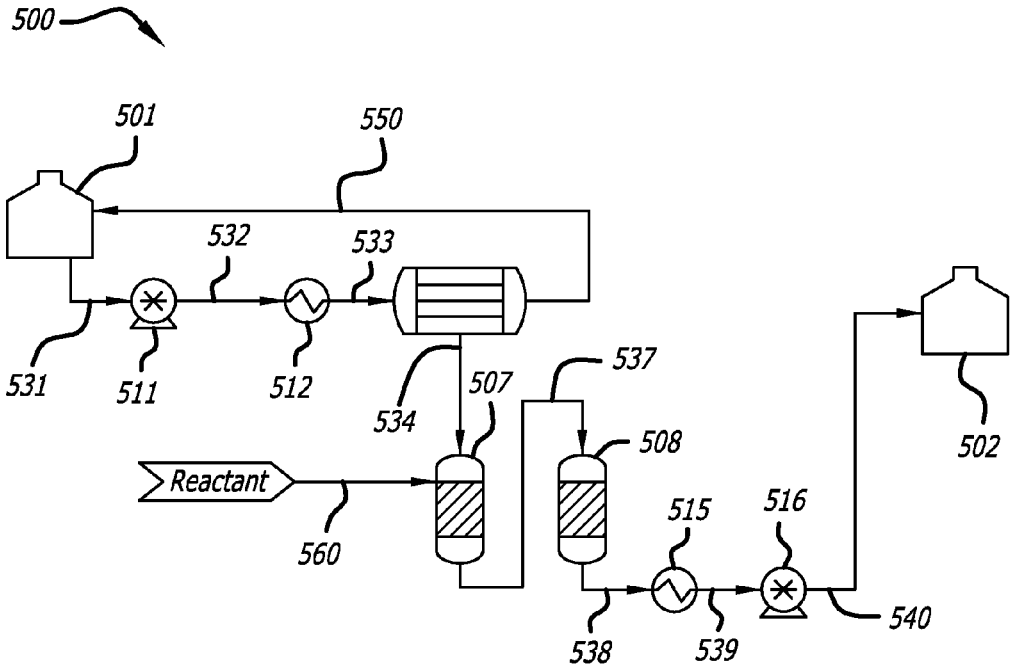
FIG. 8 is a schematic flow diagram of an exemplary system illustrative of a system shown in FIG. 7.

FIG. 8 illustrates one more detailed preferred embodiment 500 of this desulfurization process system. Fuel in bulk storage tank 501 passes through connection 531 to pump 511 to connection 532 and heat exchanger 512. Heat exchanger 512 provides heat to the fuel raising its temperature before passing through connection 533 and into stage one membrane 504. The thermal energy used in the heat exchanger 512 can be direct heat from any primary source or can be recuperated heat from systems outside the process boundary such as the primary vehicle engine, or can be recuperated heat from within the desulfurization process boundary or can be a combination of any of these sources. The fuel stream in connection 533 enters the stage one separator 504 in which the fuel is isolated into a stage one permeate 534 and a stage one retentate stream 550. The heavy sulfur groups are primarily isolated into the stage one retentate stream 550 and returned to the primary fuel tank. Only lighter sulfur groups remain in the vapor permeate stream 534. Reactant is metered into the system 500 through connection 560 and is mixed with permeate 534 and reacts on catalysts 507. The products of this reaction are sulfur species that are more easily isolated from the non-sulfur hydrocarbons. For example, they can be absorbed or adsorbed in sorbent bed 508 by passing through connection 537. This yields a low sulfur fuel vapor stream. The low sulfur vapor stream exits sorbent bed 508 through connection 538 and is condensed in heat exchanger 515 into a low sulfur fuel liquid. Heat exchanger 515 can be directly cooled by an external source such as a chiller, a cold heat sink outside the vehicle like ambient air from an aircraft at high altitude, or any recuperative cooling source within the system 500 or by any combination of these sources. The low sulfur liquid hydrocarbon auxiliary fuel then passes through connection 539 to pump 516 where it is pumped through connection 540 to the auxiliary fuel storage tank 502. This embodiment is very effective if the light sulfur groups in the permeate 534 are effectively reacted in the catalyst 507 and absorbed or adsorbed in sorbent bed 508.

If the mass ratio of the permeate stream 534 to feed stream 533 is high in system 500, resulting in heavier sulfur groups in permeate stream 534, the addition of a partial condenser is potentially needed. A preferred embodiment 560 of the processing system that includes a partial condenser 513 is illustrated in FIG. 9. In this embodiment 560 the vapor phase permeate 534 is partially condensed in heat exchanger 513 and isolated in separator 509 after passing through connection 535. The condensed liquid stream with heavier sulfur groups is pumped through connections 551 and 552 by pump 514 and returned to the tank 501. The vapor phase fraction of stream 535 is isolated by separator 509 and passed through connection 536 to RDS catalyst 507. As in the previous embodiment the remaining sulfur species in vapor phase stream 536 are reacted with reactant from connection 560 on catalyst 507. These sulfur species are converted into sulfur species that are more effectively adsorbed or absorbed on sorbent bed 508.

Another embodiment 570 of the processing system is illustrated in FIG. 10. If not all of the sulfur species in vapor stream 536 are reacted in catalyst bed 507 and isolated in sorbent bed 508, then a liquid phase sorbent bed is needed. In this embodiment 570 a liquid phase sorbent bed 506 is added just before the auxiliary fuel supply tank 502 to ensure that there is an acceptably low sulfur content in the feed stream through connection 543 of fuel being discharged into the auxiliary fuel tank 502. Otherwise the system 570 shown in FIG. 10 is identical to the system 560 shown in FIG. 9.

Figure 11:
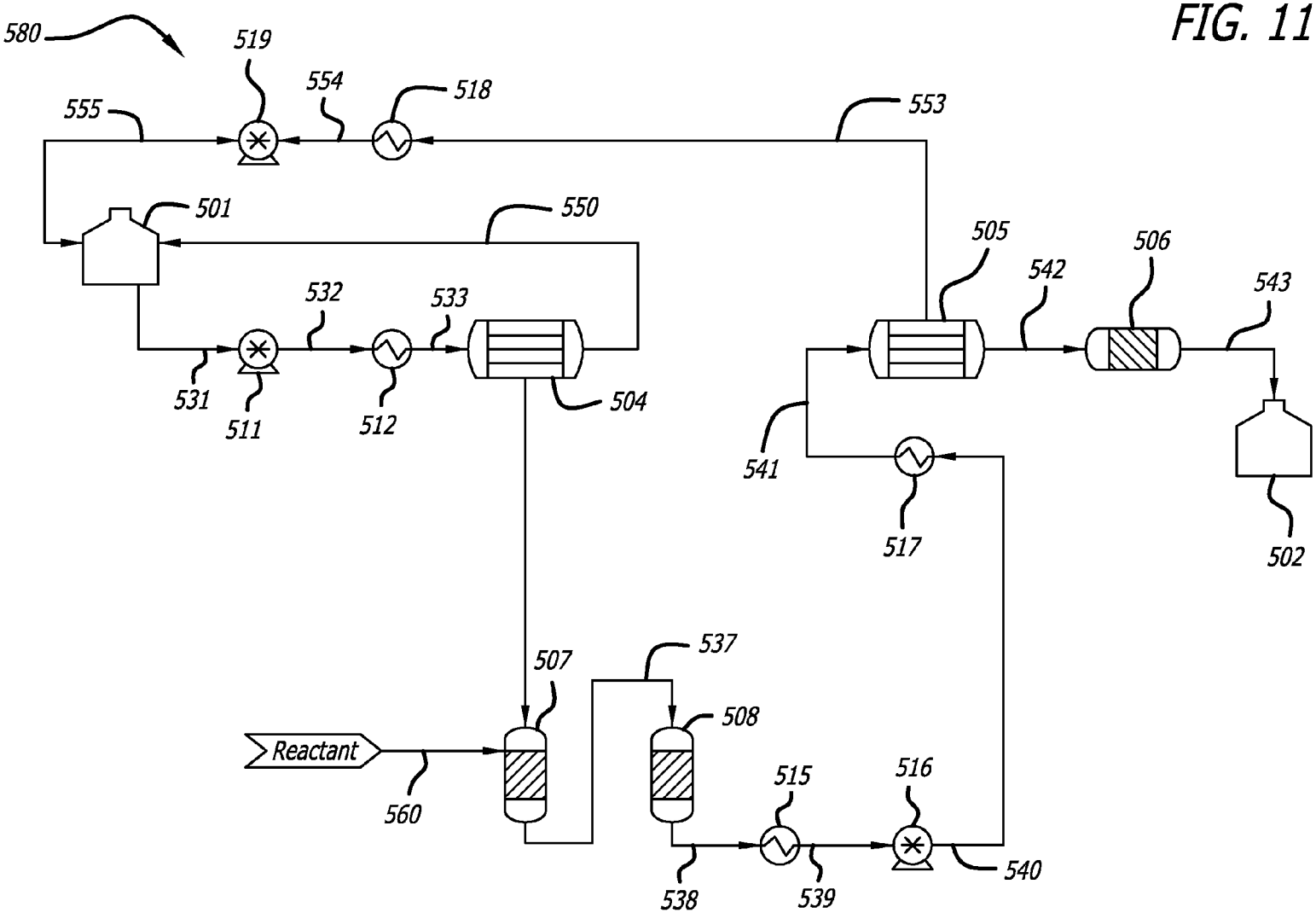
FIG. 11 is a schematic flow diagram of another exemplary system illustrative of an alternative system as in FIG. 7.

In another embodiment 580 of the processing system, illustrated in FIG. 11, the effectiveness of RDS catalyst 507 is limited to the heavier sulfur groups in vapor stream 534 and therefore, a high level of light sulfur groups 1 and/or 2 are not isolated by upstream processes and remain in the liquid stream in connection 540. In this case a second stage membrane reactor 505 can effectively be used to minimize or eliminate these groups from entering the liquid phase sorbent bed 506.

The liquid phase fuel in connection 540 is heated by heat exchanger 517 and passed through connection 541 to membrane reactor 505. In membrane reactor 505 a second stage permeate stream 553 and a second stage retentate stream 542 are isolated. The light sulfur species are isolated into the vapor phase permeate stream 553 due to the sulfur selectivity of the membrane. This vapor stream is condensed in heat exchanger 518 and pumped back into the tank 501 by pump 519.

The auxiliary fuel stream is the retentate stream 542. Based on the performance of second stage reactor 505, a polishing filter 506 may or may not be needed. The low sulfur fuel stream is then passed via connection 543 to the auxiliary storage tank 502.

Figure 12:
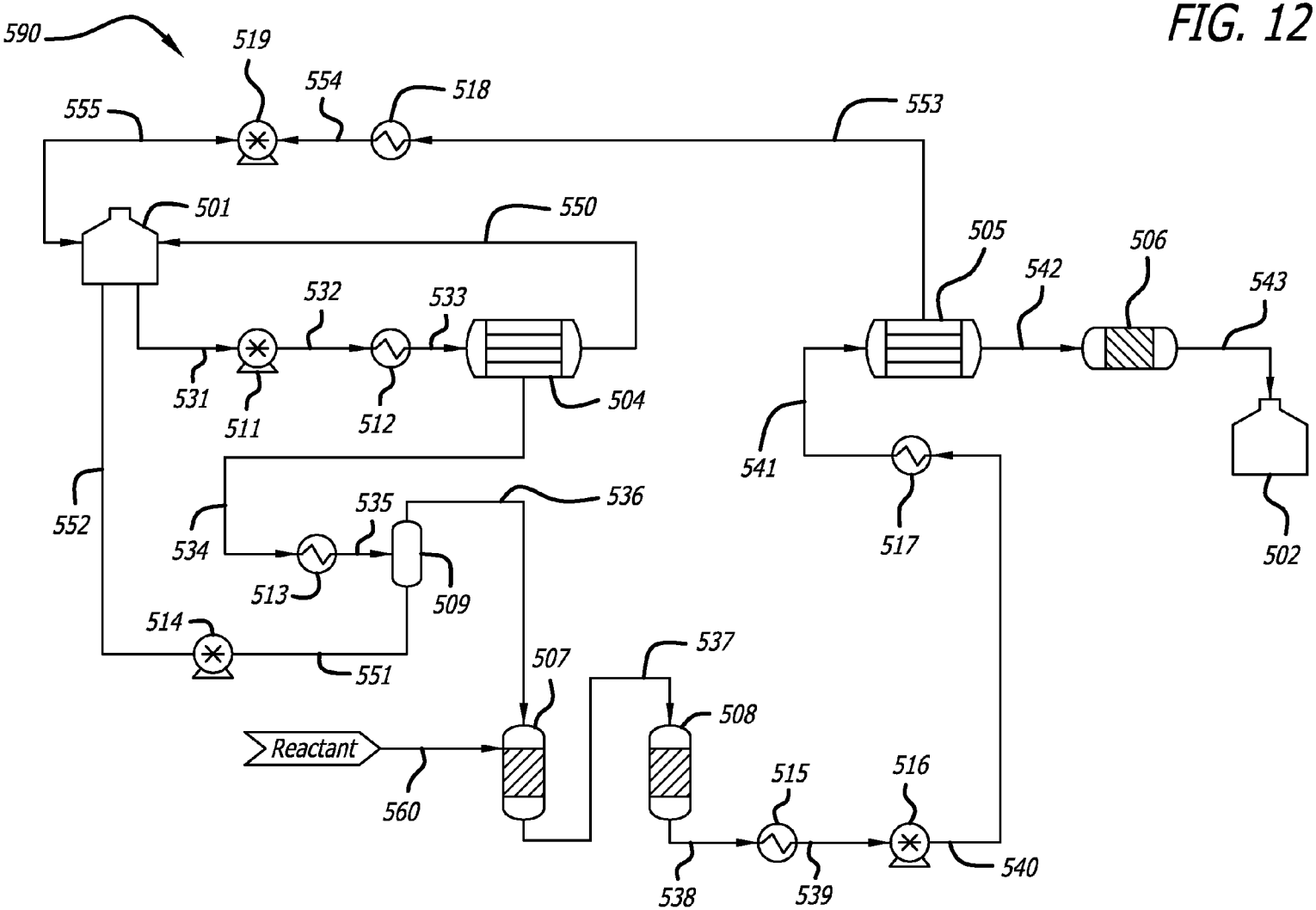
FIG. 12 is a schematic flow diagram of another exemplary system illustrative of an alternative system as in FIG. 7.

Another embodiment of the processing system 590 is illustrated in FIG. 12. In this embodiment 590 both the partial condenser 513/separator 509 and the second stage membrane reactor 505 are included. A separate discussion of this embodiment 590 is not believed to be necessary, as the features of this embodiment are simply combined from those of embodiments shown in FIGS. 9-12.

The above described desulfurization systems and methods may also be utilized in other vehicles than marine vessels. In long distance trucking applications, for example, an onboard desulfurization system can provide a supply of cleaner fuel that the trucker can utilize while at a truck stop to minimize total contribution to atmospheric pollution at those locations in particular. Further, such fuels might be preferably utilized for startup operations in colder climates as well as during the long idling periods at truck stops, or at destination stops where truckers typically leave their rig engines running.

While the apparatus, system and method have been described in terms of what are presently considered to be the most practical and preferred embodiments, it is to be understood that the disclosure need not be limited to the disclosed embodiments. It is intended to cover various modifications and similar arrangements included within the spirit and scope of the claims, the scope of which should be accorded the broadest interpretation so as to encompass all such modifications and similar structures. The present disclosure includes any and all embodiments of the following claims.

The invention claimed is:

1. A method of reducing engine environmental atmospheric pollution emissions from a vehicle having a combustion engine utilizing hydrocarbon fuel for at least one of propulsion and auxiliary electrical power, the method comprising:

providing an unprocessed bulk fuel storage container on the vehicle;

providing a clean processed fuel storage container on the vehicle;

supplying the engine for propulsion with fuel from the unprocessed fuel storage container when the vehicle is beyond a predetermined distance from an area having environmental restrictions;

passing a portion of unprocessed fuel through a desulphurization process to fill a clean fuel storage container while the vehicle is in motion; and supplying the combustion engine for one of propulsion and auxiliary electrical power from clean fuel in the processed fuel storage container when the vehicle is within an area having the environmental restrictions.

2. The method according to claim 1 wherein the desulfurization process includes one or more of membrane separation, fractionation, hydrodesulfurization, oxidative desulfurization, adsorption absorption or a combination of these processes.

3. The method according to claim 1 wherein the desulfurization process includes separating the unprocessed fuel into a stage-one permeate and a stage-one retentate, returning the stage-one retentate to the bulk fuel container, separating the stage-one permeate into a stage-two permeate and a stage-two retentate, and storing the stage-two retentate in the clean fuel container.

4. The method according to claim 3 further comprising supplying a portion of the stage-one permeate to the combustion engine.

5. The method according to claim 1 further comprising processing a portion of fuel from the bulk storage tank while the vehicle is stationary.

6. The method according to claim 1 further comprising treating the bulk fuel in liquid phase by alkylation of sulfur containing molecules to increase size of the sulfur containing molecules.

* * * * *